US007560213B2

(12) United States Patent
Matsuoka et al.

(10) Patent No.: US 7,560,213 B2
(45) Date of Patent: Jul. 14, 2009

(54) RESIN PARTICLE LIQUID DISPERSION FOR ELECTROSTATIC IMAGE DEVELOPING TONER, PRODUCTION PROCESS OF THE LIQUID DISPERSION, ELECTROSTATIC IMAGE DEVELOPING TONER, PRODUCTION PROCESS OF THE TONER, ELECTROSTATIC IMAGE DEVELOPER AND IMAGE FORMING METHOD

(75) Inventors: Hirotaka Matsuoka, Kanagawa (JP); Yuki Sasaki, Kanagawa (JP); Yasuo Matsumura, Kanagawa (JP); Fumiaki Mera, Kanagawa (JP); Satoshi Hiraoka, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 598 days.

(21) Appl. No.: 11/443,362

(22) Filed: May 31, 2006

(65) Prior Publication Data

US 2007/0141503 A1 Jun. 21, 2007

(30) Foreign Application Priority Data

Dec. 20, 2005 (JP) ..... 2005-366229

(51) Int. Cl.
*G03G 9/00* (2006.01)
*G03G 5/00* (2006.01)

(52) U.S. Cl. ..... 430/109.4; 430/114; 430/137.14; 430/137.15; 430/137.22; 430/119.1; 524/599

(58) Field of Classification Search ..... 430/114, 430/109.4, 137.14, 137.15, 137.22, 119.1; 524/599

See application file for complete search history.

(56) References Cited

FOREIGN PATENT DOCUMENTS

| | | |
|---|---|---|
| JP | A 63-282752 | 11/1988 |
| JP | A 6-250439 | 9/1994 |
| JP | A 8-60078 | 3/1996 |
| JP | A 8-295792 | 11/1996 |
| JP | A 9-501712 | 2/1997 |
| JP | A 9-216921 | 8/1997 |

*Primary Examiner*—Mark A Chapman
(74) *Attorney, Agent, or Firm*—Oliff & Berridge, PLC

(57) ABSTRACT

A resin particle liquid dispersion for an electrostatic image developing toner comprises: a terminal addition-polymerized polyester having an acid value of from about 5 to about 70 mg·KOH/g, and the terminal addition-polymerized polyester is obtained by a process comprising: polycondensing a polycondensable monomer having a composition comprising the components (a) to (c) described in the specification to obtain a polyester having an addition-polymerizable unsaturated group at a terminal; and addition-polymerizing the addition-polymerizable unsaturated group of the polyester having an addition-polymerizable unsaturated group at a terminal.

19 Claims, No Drawings

RESIN PARTICLE LIQUID DISPERSION FOR ELECTROSTATIC IMAGE DEVELOPING TONER, PRODUCTION PROCESS OF THE LIQUID DISPERSION, ELECTROSTATIC IMAGE DEVELOPING TONER, PRODUCTION PROCESS OF THE TONER, ELECTROSTATIC IMAGE DEVELOPER AND IMAGE FORMING METHOD

BACKGROUND

1. Technical Field

The present invention relates to an electrostatic image developing toner used for developing an electrostatic latent image formed by an electrophotographic process, an electrostatic recording process or the like, with a developer, a production process of the toner, a resin particle liquid dispersion usable as the raw material of the toner, and a production process of the liquid dispersion. The present invention also relates to an electrostatic image developer using the electrostatic image developing toner, and an image forming method.

2. Related Art

At present, a method of visualizing image information through an electrostatic image by an electrophotographic process is being utilized in various fields. In the electrophotographic process, an electrostatic image is formed on a photoreceptor through electrostatic charging and exposure steps, and the electrostatic latent image is developed with a developer containing a toner and then visualized through transfer and fixing steps. The developer used here includes a two-component developer comprising a toner and a carrier, and a one-component developer using a magnetic toner or a non-magnetic toner solely. The toner is generally produced by a kneading and pulverizing production process where a thermoplastic resin is melt-kneaded together with a pigment, an electrostatic charge control agent and a releasing agent such as wax and after cooling, the kneaded material is finely pulverized and then classified. In such a toner, an inorganic or organic particle is sometimes added to the toner particle surface, if desired, so as to improve flowability or cleaning property.

In recent years, a duplicator, a printer and a complex machine thereof with a facsimile or the like, each employing a color electrophotographic process, are becoming remarkably popular. In the case of realizing appropriate gloss in the reproduction of a color image or transparency for obtaining an excellent OHP image, it is generally difficult to use a releasing agent such as wax. Accordingly, a large amount of oil is applied to a fixing roll so as to assist the separation, but this causes tacky touch of a duplicated image including an OHP image, makes it difficult to write on the image with a pen or often gives a non-uniform gloss texture. In the case of a normal black-and-white copy, it is more difficult to use a wax generally employed, such as polyethylene, polypropylene and paraffin, because the OHP transparency is impaired.

Even if, for example, transparency is sacrificed, in the conventional process of producing a toner by a kneading and pulverizing method, the toner can be hardly prevented from being exposed to the surface and on use as a developer, there arises a problem such as significant deterioration of flowability or filming on the developing machine or photoreceptor.

As a method for fundamentally solving these problems, a production process by a polymerization method has been proposed, where an oil phase comprising a monomer working out to a raw material of a resin, and a colorant is dispersed in an aqueous phase and then directly polymerized to form a toner, thereby enclosing the wax inside the toner and preventing exposure to the surface.

In the above-described electrophotographic process, for providing a high-quality image and stably maintaining the toner performance under various mechanical stresses, it is very important to select the pigment and releasing agent, optimize the amounts thereof, prevent the releasing agent from exposure to the surface, optimize the resin properties to improve the gloss and releasability without a fixing oil, and suppress the hot offset.

On the other hand, a technique for enabling fixing at a lower temperature is demanded in order to reduce the energy consumption and in particular, it is recently required to stop energizing the fixing machine except for the operating time so that thorough energy saving can be attained. Therefore, the temperature of the fixing machine must be instantaneously elevated to the working temperature upon energization. In this respect, the heat capacity of the fixing machine is preferably as small as possible but if the case is so, the fluctuation width of the temperature of the fixing machine tends to be larger than ever. That is, the overshoot of the temperature after start of energization increases, and the temperature drop due to passing of paper also increases. Furthermore, when paper in a width smaller than the width of the fixing machine is continuously passed, the temperature difference between the paper passing part and the paper non-passing part becomes large. Particularly, in the case of use in a high-speed duplicator or printer, such a phenomenon is more liable to occur because the capacity of the power source tends to run short. Accordingly, an electrostatic image developing toner which can be fixed at a low temperature but is free from generation of offset until a higher temperature region, that is, which has a wide fixing latitude, is strongly demanded.

As for the technique of lowering the fixing temperature of the toner, there is known a method where a polycondensation-type crystalline resin showing a sharp melting behavior with respect to the temperature is used as the binder resin constituting the toner. However, a crystalline resin is generally difficult to pulverize by a conventional method and cannot be used in many cases.

Also, for the polymerization of a polycondensation-type resin, the reaction must be performed for a long time of 10 hours or more at a high temperature exceeding 200° C. under highly reduced pressure with stirring by the use of a large force, and this incurs massive energy consumption. In addition, a huge equipment investment is often required for obtaining durability of the reaction equipment.

In the case of producing a toner by an emulsion polymerization and aggregation method as described above, the polycondensation-type crystalline resin after polymerization may be emulsified in an aqueous medium to form a latex and then aggregated in this state with a pigment, a wax and the like, followed by fusing and coalescence.

However, the emulsification of the polycondensed resin requires an extremely inefficient and highly energy-consuming step, for example, a step of emulsifying the resin under high shearing at a high temperature exceeding 150° C. or a step of dissolving the resin in a solvent to attain a low viscosity, dispersing the solution in an aqueous medium and then removing the solvent.

Also, at the emulsification in an aqueous medium, a problem such as hydrolysis can be hardly evaded, and the material design inevitably encounters generation of an uncertain factor.

These problems are prominent in a crystalline resin but not limited to a crystalline resin and the same also occurs in the case of a non-crystalline resin.

SUMMARY

According to an aspect of the invention, there is provided a resin particle liquid dispersion for an electrostatic image developing toner, comprising:

a dispersion medium; and a resin particle containing at least a polyester dispersed in the dispersion medium, wherein the polyester comprises a terminal addition-polymerized polyester having an acid value of from about 5 to about 70 mg·KOH/g, and the terminal addition-polymerized polyester is obtained by a process comprising:

polycondensing a polycondensable monomer having a composition comprising:

(a) at least one of a polyvalent acid monomer having no addition-polymerizable unsaturated group and a derivative of the polyvalent acid monomer having no addition-polymerizable unsaturated group in an amount of from about 10 to about 80 mol % based on all monomers;

(b) a polyhydric alcohol monomer having no addition-polymerizable unsaturated group in an amount of from about 10 to about 80 mol % based on all monomers; and (c) at least one of a monomer having a carboxyl group and an addition-polymerizable unsaturated group and a derivative of the monomer having a carboxyl group and an addition-polymerizable unsaturated group in an amount of from about 0.5 to about 20 mol % based on all monomers, to obtain a polyester having an addition-polymerizable unsaturated group at a terminal; and addition-polymerizing the addition-polymerizable unsaturated group of the polyester having an addition-polymerizable unsaturated group at a terminal.

DETAILED DESCRIPTION

The resin particle liquid dispersion of the present invention is a resin particle liquid dispersion including a dispersion medium having dispersed therein a resin particle containing at least a polyester, wherein the polyester includes a terminal addition-polymerized polyester having an acid value of about 5 to 70 mg·KOH/g obtained by polycondensing a polycondensable monomer (composition) having a composition comprising (a) a polyvalent acid monomer having no addition-polymerizable unsaturated group and/or a derivative thereof in an amount of 10 to 80 mol % based on all monomers, (b) a polyhydric alcohol monomer having no addition-polymerizable unsaturated group in an amount of 10 to 80 mol % based on all monomers, and (c) a monomer having a carboxyl group and an addition-polymerizable unsaturated group and/or a derivative thereof in an amount of about 0.5 to 20 mol % based on all monomers, to obtain a polyester having an addition-polymerizable unsaturated group at the terminal, and addition-polymerizing the addition-polymerizable unsaturated group of the polyester.

The present invention is described in detail below.

Use of a polyester resin obtained by polycondensation using a polycondensation catalyst at about 150° C. or less is very important for reducing the total energy in the production of a toner. By virtue of using a crystalline or amorphous polyester obtained in this way, low-temperature fixing as a toner can be realized and this is greatly meaningful in view of reduction of environmental load which is recently concerned about.

Also, in the case of using an organic solvent at the emulsification and particle formation of a polyester, not only a large investment is required for the recovery equipment but also this is not preferred in view of environmental safety. Furthermore, the solvent used is difficult to completely remove from the toner and there is also a problem in view of quality such as toner storage stability.

The method for enhancing the water dispersibility of a polyester includes a method of introducing a hydrophilic group into the polyester chain by copolymerizing, as the polyester monomer, a monomer having an alkali metal salt of sulfonic acid, an alkali metal salt of carboxylic acid or the like resulting from neutralization of a sulfonic acid, a carboxylic acid or the like with a base, and a method of producing a polyester having a sulfonic acid or a carboxylic acid and then dispersing the polyester in an alkali water to introduce a sulfonate or a carboxylate. However, for imparting satisfactory emulsifiability to the polyester obtained by such a method of introducing a hydrophilic group into the chain, many hydrophilic polar groups need to be introduced, and a toner produced by using such a polyester has a problem in the chargeability.

Also, a polyester where a polyester having an unsaturated bond is grafted to a vinyl-based monomer so as to impart water dispersibility to the polyester has been proposed, but gelling may occur due to insufficient control of grafting or elevation in the viscosity of polyester and microparticulation to a level of a resin particle liquid dispersion suitable for use as a toner can be hardly achieved. In addition, grafting of a polyester to a vinyl-based resin brings about compatibilization and by the effect of plasticization, the glass transition temperature as a toner readily decreases and tends to be equal to or less than the in-machine temperature in the electrophotographic process, giving rise to an image defect.

In the present invention, a polyester having a graft structure causing such a trouble is not used, and the polyester monomer is limited to a monomer not having an addition-polymerizable unsaturated group. Here, the polyester monomer means a polycondensable monomer to form a polyester by polycondensation reaction, and corresponds to the components (a) and (b). Furthermore, a polyester is formed by using an addition-polymerizable unsaturated monomer having a carboxyl group capable of reacting with the polyester terminal, an oligomer thereof and/or a prepolymer thereof. When the polyester terminal is effectively modified by an unsaturated vinyl monomer having a neutralizable polar group, water dispersion and particle formation of a polyester can be effected by the use of a small amount of an addition-polymerizable unsaturated monomer as compared with the copolymerization into the chain. Furthermore, the amount of a neutralizer required at the water dispersion can be minimized and reduction in the chargeability under high-temperature high-humidity conditions can be thereby avoided.

Also, when a polymerization initiator is added to the latex after water dispersion and the addition-polymerizable unsaturated monomer is addition-polymerized, instability of the addition-polymerizable unsaturated group can be eliminated. As a result, a resin particle liquid dispersion having a particle diameter suitable for use as a toner can be produced without causing a problem in the production process, such as gelling.

In addition, by virtue of addition-polymerizing the addition-polymerizable unsaturated monomer, an addition-polymerization type resin can be effectively disposed on the latex surface and the chargeability of a toner can be successfully maintained.

(Resin Particle Liquid Dispersion)

The resin particle liquid dispersion of the present invention is a resin particle liquid dispersion comprising a dispersion medium having dispersed therein a resin particle containing at least a polyester, wherein the resin particle liquid dispersion includes a terminal addition-polymerized polyester having an acid value of about 5 to 70 mg·KOH/g obtained by polycondensing a polycondensable monomer having a composition including components (a) to (c) to obtain a polyester having an addition-polymerizable unsaturated group at the terminal and then addition-polymerizing the addition-polymerizable unsaturated group of the polyester.

The resin particle liquid dispersion of the present invention can be suitably used as a resin particle liquid dispersion for an electrostatic image developing toner (hereinafter sometimes simply referred to as a "resin particle liquid dispersion").

The resin particle liquid dispersion of the present invention is preferably a resin particle liquid dispersion where a resin particle is emulsion-dispersed to a median diameter of about 0.05 to 2.0 μm in an aqueous medium, and the resin particle liquid dispersion is preferably obtained by polycondensing a polyester-producing polycondensable monomer having no addition-polymerizable group and a monomer having a carboxyl group and an addition-polymerizable unsaturated group and/or a derivative in the presence of a polycondensation catalyst to obtain a polyester (hereinafter sometimes referred to as a "polycondensed resin") in which the addition-polymerizable unsaturated group at the polyester terminal is addition-polymerized, and then dispersing the polyester in an aqueous medium to form particles. Incidentally, in the component (c), the derivative of a monomer having a carboxyl group and an addition-polymerizable unsaturated group indicates an oligomer of a monomer having a carboxyl group and an addition-polymerizable unsaturated group, or a prepolymer of a monomer having a carboxyl group and an addition-polymerizable unsaturated group. The oligomer and prepolymer are described later.

The resin particle liquid dispersion of the present invention is preferably produced by the production process described later.

The polycondensable monomer contains (a) a polyvalent acid monomer having no addition-polymerizable unsaturated group in an amount of 10 to 80 mol % based on all monomers and (b) a polyhydric alcohol monomer having no addition-polymerizable unsaturated group in an amount of 10 to 80 mol % based on all monomers.

Here, the important matter is the ratio of the polyvalent acid monomer or an anhydride and/or lower alkyl ester monomer thereof and the polyhydric alcohol monomer, and the ratio in terms of the molar ratio of polyvalent acid monomer:polyhydric alcohol monomer is preferably, for example, as a value obtained by dividing the polyvalent acid monomer by the polyhydric alcohol monomer, from about 0.5 to about 2.0, more preferably from about 0.7 to about 1.5, and in view of polycondensation, most preferably from about 0.8 to about 1.2.

The term "all monomers" as used herein indicates all monomers constituting the terminal addition-polymerized polyester and includes all of the components (a) to (c).

Also, the derivative of a polyvalent acid monomer in the component (a) indicates an anhydride of a polyvalent acid or a lower alkyl ester of a polyvalent acid. Furthermore, in the present invention, the lower alkyl ester indicates an alkyl ester in which the alkoxy moiety of an ester has a carbon number of 1 to 8.

The molar ratio of the number of carboxyl groups in the component (a) and the number of hydroxy groups in the component (b) is preferably, as a value obtained by dividing the number of hydroxy groups in the component (b) by the number of carboxyl groups in the component (a), from more than 1.0 to about 2.0, more preferably from about 1.05 to about 1.8, still more preferably from about 1.05 to about 1.5. Within such a range, the component (c) can be satisfactorily introduced into the polyester and this is preferred.

The carboxyl group in the component (a) includes a carboxyl group, an acid anhydride group and a lower alkyl ester group, and the acid anhydride group and the lower alkyl ester group are counted as two carboxyl groups and one carboxyl group, respectively.

<Monomer Having Carboxyl Group and Addition-Polymerizable Unsaturated Group, and Oligomer and/or Prepolymer Thereof (Component (c))>

The polycondensable monomer contains (c) a monomer having a carboxyl group and an addition-polymerizable unsaturated group and/or a derivative thereof in an amount of about 0.5 to about 20 mol % based on all monomers.

The monomer having a carboxyl group and an addition-polymerizable unsaturated group and/or a derivative thereof (component (c)), which reacts with the component (b), may be used in an amount of about 0.5 to about 20 mol %, preferably from about 1.0 to about 10 mol %, based on all monomers. If the amount of the component (c) used is less than about 0.5 mol %, the polyester is not satisfactorily hydrophilized and the particle cannot be made small to a particle diameter suitable as a resin particle liquid dispersion, whereas if the amount of the component (c) used exceeds about 20 mol %, the hydrophilicity of the polyester is excessively intensified and when a toner is produced, the chargeability under high-temperature high-humidity conditions decreases.

The number of carboxyl groups in the monomer having a carboxyl group and an addition-polymerizable unsaturated group may be 1 or more, but the number of carboxyl groups is preferably 1, because the component (c) can be easily polycondensed not to the inside but to the terminal of the polyester and even when the components (a) to (c) are mixed together and polycondensed, a polyester having an addition-polymerizable unsaturated group at the terminal can be readily obtained.

As for the component (c) usable in the present invention, only one member selected from a monomer having a carboxyl group and an addition-polymerizable unsaturated group, an oligomer thereof and a prepolymer thereof may be used, or two or more members thereof may be used in combination. Also, one kind of an addition-polymerizable unsaturated monomer may be used alone, or two or more kinds of addition-polymerizable unsaturated monomers may be used in combination.

In the present invention, at the polycondensation of a polyester, the monomer having a carboxyl group and an addition-polymerizable unsaturated group and/or a derivative thereof can be reacted with the components (a) and (b) at a low temperature of 150° C. or less preferred in view of environmental load, and the addition-polymerizable unsaturated group originated in the monomer having a carboxyl group and an addition-polymerizable unsaturated group or a derivative thereof is finally addition-polymerized, whereby a composite particle of a polyester and an addition-polymerization type polymer can be obtained.

Incidentally, in the present invention, the oligomer of the monomer having a carboxyl group and an addition-polymerizable unsaturated group is a polymer of two or more of the above-described monomers, having a molecular weight of about 2,500 or less, preferably from about 500 to about 2,500, and the prepolymer of the addition-polymerizable unsaturated monomer is a polymer of two or more of the above-described monomers, having a molecular weight of about 2,500 to about 10,000. The polymer indicates a polymerization or polycondensation product having a molecular weight of about 10,000 or more. In the present invention, these oligomer and prepolymer are dealt with as a monomer.

The addition-polymerizable unsaturated group is sufficient if it is an unsaturated group capable of addition polymerization, and preferred examples thereof include an ethylenically unsaturated group. An unsaturated group difficult of addition polymerization, such as unsaturated group in an aromatic ring structure, is not included.

The monomer having a carboxyl group and an addition-polymerizable unsaturated group, which can be used in the present invention, may be a radical polymerizable monomer, a cationic polymerizable monomer or an anionic polymerizable monomer, and among these, a radical polymerizable unsaturated monomer is preferred.

Examples of the monomer having a carboxyl group and an addition-polymerizable unsaturated group, which can be used in the present invention, include, but are not limited to, ethylenically unsaturated carboxylic acid and known crosslinking agents. Suitable examples of the ethylenically unsaturated carboxylic acid include an acrylic acid, a methacrylic acid, an itaconic acid, a maleic acid, a fumaric acid and 2-carboxyethyl acrylate (β-CEA). The monomer is more preferably an oligomer comprising a (meth)acryl monomer having $CH_2{=}C(R')—COOH$ or $CH_2{=}C(R')—COO—R''-Z$ (wherein R' represents H or $CH_3$, R" represents an alkylene group having a carbon number of 2 to 6, and Z represents —COOH) and/or from 2 to 7 monomer units, and most preferably an oligomer comprising from 2 to 7 monomer units of 2-carboxyethyl acrylate. One of these addition-polymerizable unsaturated monomers may be used alone, or two or more thereof may be used in combination.

The polyester usable in the present invention has an acid value of about 5 to about 70 mg·KOH/g, more preferably from about 8 to about 40 mg·KOH/g, and most preferably from about 10 to about 20 mg·KOH/g. If the acid value is less than about 5 mg·KOH/g, the polyester is not satisfactorily hydrophilized and particle formation to a particle diameter suitable as a resin particle liquid dispersion cannot be effected, whereas if the acid value exceeds about 70 mg·KOH/g, the hydrophilicity of a toner produced is excessively intensified and the chargeability under high-temperature high-humidity conditions is decreased.

<Polyester-Producing Polycondensable Monomer (Including Components (a) and (b))>

Examples of the polyester-producing polycondensable monomer usable in the present invention include a polyvalent carboxylic acid, a polyol, a hydroxycarboxylic acid and a mixture thereof, and the important matter is not to have an addition-polymerizable unsaturated group. In particular, the polycondensable monomer is preferably a polyvalent carboxylic acid, a polyol or an ester compound thereof (oligomer and/or prepolymer), and those of giving a polyester directly by an ester reaction or through a transesterification reaction are preferred. In this case, the polyester polymerized may take a mode of amorphous polyester (non-crystalline polyester), crystalline polyester or the like, or a mixed mode thereof.

The polyvalent acid monomer in the component (a) is preferably a polyvalent carboxylic acid.

The polyvalent carboxylic acid usable in the present invention is a compound having no addition-polymerizable unsaturated group and containing two or more carboxyl groups within one molecule. Out of these compounds, a dicarboxylic acid is a compound containing two carboxyl groups within one molecule, and examples thereof include an oxalic acid, a succinic acid, a maleic acid, an adipic acid, a β-methyladipic acid, an azelaic acid, a sebacic acid, a nonanedicarboxylic acid, a decanedicarboxylic acid, an undecanedicarboxylic acid, a dodecanedicarboxylic acid, a fumaric acid, a citraconic acid, a diglycolic acid, a cyclohexane-3,5-diene-1,2-carboxylic acid, a malic acid, a citric acid, a hexahydroterephthalic acid, a malonic acid, a pimelic acid, a tartaric acid, a mucic acid, a phthalic acid, an isophthalic acid, a terephthalic acid, a tetrachlorophthalic acid, a chlorophthalic acid, a nitrophthalic acid, a p-carboxyphenylacetic acid, a p-phenylenediacetic acid, an m-phenylenediacetic acid, an o-phenylenediacetic acid, a diphenyldiacetic acid, a diphenyl-p,p'-dicarboxylic acid, a naphthalene-1,4-dicarboxylic acid, a naphthalene-1,5-dicarboxylic acid, a naphthalene-2,6-dicarboxylic acid and an anthracene dicarboxylic acid. Examples of the polyvalent carboxylic acid other than the dicarboxylic acid include a trimellitic acid, a pyromellitic acid, a naphthalenetricarboxylic acid, a naphthalenetetracarboxylic acid, a pyrenetricarboxylic acid, a pyrenetetracarboxylic acid and a lower ester thereof. An acid chloride thereof is also included, but the present invention not limited thereto. One of these polyvalent carboxylic acids may be used alone, or two or more thereof may be used in combination. The lower ester means that the carbon number in the alkoxy moiety of the ester is from 1 to 8. Specific examples thereof include methyl ester, ethyl ester, n-propyl ester, isopropyl ester, n-butyl ester and isobutyl ester.

The polyhydric alcohol (polyol) usable in the present invention is a compound having no addition-polymerizable unsaturated group and having two or more hydroxyl groups within one molecule. Out of these compounds, the diol is a compound having two hydroxyl groups within one molecule, and examples thereof include ethylene glycol, propylene glycol, butanediol, diethylene glycol, hexanediol, cyclohexanediol, octanediol, decanediol and dodecanediol. Examples of the polyol other than the diol include glycerin, pentaerythritol, hexamethylolmelamine, hexaethylolmelamine, tetramethylolbenzoguanamine and tetraethylolbenzoguanamine. One of these polyhydric alcohols may be used alone, or two or more thereof may be used in combination.

An amorphous resin or a crystalline resin can be easily obtained according to the combination of these polycondensable monomers.

Examples of the polyvalent carboxylic acid used for obtaining a crystalline polyester include an oxalic acid, a malonic acid, a succinic acid, a glutaric acid, an adipic acid, a pimelic acid, a suberic acid, an azelaic acid, a sebacic acid, a maleic acid, a fumaric acid, a citraconic acid, an itaconic acid, a glutaconic acid, an n-dodecylsuccinic acid, an n-dodecenylsuccinic acid, an isododecylsuccinic acid, an isodecenylsuccinic acid, an n-octylsuccinic acid, an n-octenylsuccinic acid, and an acid anhydride or lower ester thereof. An acid chloride thereof is also included, but the present invention is not limited thereto.

Examples of the polyol used for obtaining a crystalline polyester include ethylene glycol, diethylene glycol, triethylene glycol, 1,2-propylene glycol, 1,3-propylene glycol, 1,4-butanediol, 1,4-butenediol, neopentyl glycol, 1,5-pentaneglycol, 1,6-hexaneglycol, 1,4-cyclohexanediol, 1,4-cyclohexanedimethanol, dipropylene glycol, polyethylene glycol, polypropylene glycol, polytetramethylene glycol, bisphenol A, bisphenol Z and hydrogenated bisphenol A.

Examples of the polyvalent carboxylic acid used for obtaining an amorphous polyester include, but are not limited to, an aromatic dicarboxylic acid such as dibasic acid (e.g., phthalic acid, isophthalic acid, terephthalic acid, naphthalene-2,6-dicarboxylic acid, malonic acid, mesaconic acid), and a lower ester thereof. Examples of the trivalent or higher-valent carboxylic acid include, but are not limited to, 1,2,4-benzenetricarboxylic acid, 1,3,5-benzenetricarboxylic acid, 1,2,4-naphthalenetricarboxylic acid, an anhydride thereof, sodium 2-sulfoterephthalate, sodium 5-sulfoisophthalate, sodium sulfosuccinate, and a lower ester thereof.

Examples of the crystalline polyester include a polyester obtained by reacting 1,9-nonanediol and 1,10-decanedicarboxylic acid, a polyester obtained by reacting cyclohexanediol and adipic acid, a polyester obtained by reacting 1,6-hexanediol and sebacic acid, a polyester obtained by reacting ethylene glycol and succinic acid, a polyester obtained by reacting ethylene glycol and sebacic acid, and a polyester obtained by reacting 1,4-butanediol and succinic acid. Among these, preferred are a polyester obtained by reacting 1,9-nonanediol and 1,10-decane-dicarboxylic acid and a polyester obtained by reacting 1,6-hexanediol and sebacic acid, but the present invention is not limited thereto.

In the case of a crystalline resin, the crystalline melting point Tm is preferably from about 50 to about 120° C., more preferably from about 55 to about 90° C. When Tm is about 50° C. or more, the binder resin itself exhibits good cohesive force in the high-temperature region and excellent releasability or high hot offset resistance is obtained at the fixing, and when Tm is about 120° C. or less, this is advantageous in that satisfactory melting is effected and the minimum fixing temperature is hardly elevated.

Here, the melting point of the crystalline resin is measured by using a differential scanning calorimeter (DSC) and can be determined as a melt peak temperature of the input compensation differential scanning calorimetry prescribed in JTS K-7121 when the measurement is performed by elevating the temperature at a rate of 10° C./min from room temperature to 150° C. The crystalline resin sometimes shows a plurality of melt peaks but in the present invention, the maximum peak is designated as the melting point.

The glass transition point of the amorphous resin means a value measured by the method prescribed in ASTM D3418-82 (DSC method).

In the case where the polycondensable resin particle is an amorphous resin, the glass transition point Tg is preferably from about 40 to about 80° C., more preferably from about 50 to about 65° C. When Tg is about 40° C. or more, the binder resin itself exhibits good cohesive force in the high-temperature region and excellent hot offset resistance is obtained at the fixing, and when Tg is about 80° C. or less, this is advantageous in that satisfactory melting is effected and the minimum fixing temperature is hardly elevated.

The polyhydric alcohol used for obtaining an amorphous polyester is preferably, for example, an aliphatic, alicyclic or aromatic alcohol, and examples thereof include, but are not limited to, 1,5-pentanediol, 1,6-hexanediol, 1,4-cyclohexanediol, 1,4-cyclohexane-dimethanol, dipropylene glycol, polyethylene glycol, polypropylene glycol, polytetramethylene glycol, bisphenol A, bisphenol Z and hydrogenated bisphenol A.

In the present invention, in addition to the components (a) to (c), a hydroxycarboxylic acid may also be used in combination as the polycondensable monomer. Examples of the hydroxycarboxylic acid include a hydroxy-heptanoic acid, a hydroxyoctanoic acid, a hydroxydecanoic acid and a hydroxyundecanoic acid.

The weight average molecular weight of the polycondensed resin obtained by polycondensing polycondensable monomers and addition-polymerizing the addition-polymerizable unsaturated group is preferably from about 1,500 to about 40,000, more preferably from about 3,000 to about 30,000. When the weight average molecular weight is about 1,500 or more, the binder resin exhibits good cohesive force and high hot offset resistance is obtained, and when it is about 40,000 or less, this is advantageous in that the hot offset resistance is excellent and the minimum fixing temperature shows a good value. Also, a part of the polycondensed resin may be caused to have a branched or crosslinked structure, for example, by selecting the carboxylic acid valence or alcohol valence of monomers.

The median diameter (center diameter) of resin particles in the resin particle liquid dispersion of the present invention is preferably from about 0.05 to about 2.0 μm, more preferably from about 0.1 to about 1.5 μm, still more preferably from about 0.1 to about 1.0 μm. When the median diameter is in this range, the dispersion state of resin particles in an aqueous medium is stabilized as described above. Accordingly, in the production of a toner, when this median diameter is about 0.05 μm or more, good aggregating property and less generation of isolated resin particles are ensured at the particle formation, or the viscosity of the system is hardly increased and this advantageously makes it easy to control the particle diameter. On the other hand, when the median diameter is about 2.0 μm or less, not only good particle size distribution is obtained due to less generation of coarse powder but also a releasing agent such as wax is scarcely isolated, so that excellent releasability or high offset resistance can be advantageously obtained at the fixing.

The median diameter of the polycondensed resin particle can be measured, for example, by a laser diffraction-type particle size distribution measuring device (LA-920, manufactured by Horiba Ltd.).

The resin particle liquid dispersion of the present invention preferably ensures that not only the median diameter is in the above-described range but also ultrafine powder or ultracoarse powder is not generated, and the ratio of the polycondensed resin particle having a median diameter of 0.03 μm or less or a particle diameter of 5.0 μm or more is preferably about 10% or less, more preferably about 5% or less, based on the entire liquid dispersion. This ratio can be obtained, for example, by plotting the relationship between the particle diameter and the frequency integration based on the measurement results by LA-920 and determining the ratio from the accumulated frequency of 0.03 μm or less or that of 5.0 μm or more.

(Production Process of Resin Particle Liquid Dispersion)

The production process of a resin particle liquid dispersion of the present invention preferably includes a step of polycondensing a polycondensable monomer having a composition including (a) to (c) by using a polycondensation catalyst to obtain a polyester having an addition-polymerizable unsaturated group at the terminal (hereinafter sometimes referred to as a "polycondensation step"), a step of dispersing the obtained polyester in an aqueous medium (hereinafter sometimes referred to as a "dispersion step"), and a step of addition-polymerizing the addition-polymerizable unsaturated group in the polyester (hereinafter sometimes referred to as an "addition-polymerization step").

As for the steps in the production process of a resin particle liquid dispersion of the present invention, a step of obtaining a polyester based on a polycondensable monomer and a monomer having a carboxy group and an addition-polymerizable unsaturated group and/or a derivative thereof, which reacts with the polycondensable monomer, by using a polycondensation catalyst is first performed. At this time, the monomer having a carboxy group and an addition-polymerizable unsaturated group and/or a derivative thereof may be used from the beginning together with the polycondensable monomer or may be added during polycondensation but is preferably added during polycondensation so that the molecular weight of the polyester can reach the desired range.

As for the steps in the production process of a resin particle liquid dispersion of the present invention, a step of dispersing the polyester having an addition-polymerizable unsaturated group at the terminal in an aqueous medium is then preferably performed. At this time, it is more preferred to neutralize the carboxylic acid group at the polyester terminal or the carboxylic acid group in the monomer having a carboxyl group and an addition-polymerizable unsaturated group and/or a derivative thereof. The amount of an alkali used for the neutralization is adjusted based on the acid value and is preferably from about 50 to about 200% of the acid value. Within this range, the hydrophilized polyester is formed into particles by normal emulsification and/or shearing of a disperser.

The production process of a resin particle liquid dispersion of the present invention preferably further comprises, as the next step, a step of addition-polymerizing the addition-polymerizable unsaturated group of the polyester.

In the production process of a resin particle liquid dispersion of the present invention, the reaction is preferably performed at a temperature lower than the conventional reaction temperature. The reaction temperature at the polycondensation and addition polymerization is preferably from about 70 to about 150° C., more preferably from about 70 to about 140° C., still more preferably from about 80° C. to less than 140° C. If the reaction temperature is less than this range, for example, the reactivity may be reduced due to decrease in the solubility of monomer or in the catalytic activity or the extension of molecular weight may be inhibited, whereas if the reaction temperature exceeds the above-described range, this deviates from the original purpose of a low-energy production process. Furthermore, coloration of the resin or decomposition or the like of the produced polyester may occur. The reaction time at the polycondensation varies depending on the reaction temperature but is preferably from about 0.5 to about 72 hours, more preferably from about 1 to about 48 hours.

The polycondensation step in the present invention is a step of polycondensing a polycondensable monomer having a composition comprising (a) to (c) by using a polycondensation catalyst to obtain a polyester having an addition-polymerizable unsaturated group at the terminal.

The polycondensation reaction in the polycondensation step of the present invention may be performed by a general polycondensation process such as bulk polymerization, emulsion polymerization, submerged polymerization (e.g., suspension polymerization), solution polymerization and interfacial polymerization, but submerged polymerization is preferred. Also, the reaction may be performed under atmospheric pressure, but when the purpose is to increase the molecular weight of the polyester, general conditions such as reduced pressure or nitrogen stream can be widely employed.

<Polycondensation Catalyst>

In the polycondensation reaction of the present invention, a polycondensation catalyst is preferably used, because the reaction rate can be increased.

The polycondensation reaction in the polycondensation of a polyester is performed by using a polycondensation catalyst. Also, a known polycondensation catalyst may be previously blended in the polycondensable monomer, if desired. Furthermore, for polycondensing the polycondensable monomer at a low temperature of about 150° C. or less or about 100° C. or less, a polycondensation catalyst is usually used. With respect to the polycondensation catalyst having catalytic activity at a low temperature, for example, an acid-based catalyst, a rare earth-containing catalyst or a hydrolase may also be used.

The acid-based catalyst is preferably an acid-based catalyst showing acidity, such as Broensted acid, and specific examples thereof include a sulfonic acid such as toluenesulfonic acid, benzenesulfonic acid and camphorsulfonic acid, and an Na salt thereof.

Furthermore, an acid having a surface activating effect may also be used. The acid having a surface activating effect is an acid having a chemical structure comprising a hydrophobic group and a hydrophilic group, in which at least a part of the hydrophilic group comprises a proton.

Examples of the acid having a surface activating effect include an alkylbenzenesulfonic acid (e.g., dodecylbenzenesulfonic acid, isopropylbenzenesulfonic acid, camphorsulfonic acid), an alkylsulfonic acid, an alkyldisulfonic acid, an alkylphenolsulfonic acid, an alkylnaphthalenesulfonic acid, an alkyltetralinesulfonic acid, an alkylallylsulfonic acid, a petroleum sulfonic acid, an alkylbenzimidazolesulfonic acid, a higher alcohol ether sulfonic acid, an alkyldiphenylsulfonic acid, a higher fatty acid sulfuric ester (e.g., monobutyl-phenylphenol sulfuric acid, dibutyl-phenylphenol sulfuric acid, dodecylsulfuric acid), a higher alcohol sulfuric ester, a higher alcohol ether sulfuric ester, a higher fatty acid amidealkylol sulfuric ester, a higher fatty acid amidoalkylated sulfuric ester, a naphthenyl alcohol sulfuric acid, a sulfated fat, a sulfosuccinic acid ester, various fatty acids, a sulfonated higher fatty acid, a higher alkylphosphoric acid ester, a resin acid, a resin acid alcohol sulfuric acid, a naphthenic acid, a p-toluenesulfonic acid, and salt compounds of all of these acids. If desired, plural species selected from these may be used in combination.

As for the rare earth-containing catalyst, those containing scandium (Sc), yttrium (Y), lanthanum (La) as lanthanoid element, cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), lutetium (Lu) or the like are effective. In particular, those having an alkylbenzenesulfonate, alkylsulfuric ester salt or triflate structure are effective.

The rare earth-containing catalyst is preferably a rare earth-containing catalyst having a triflate structure such as scandium triflate, yttrium triflate and lanthanoid triflate. The lanthanoid triflate is described in detail in Journal of Synthetic Organic Chemistry, Japan, Vol. 53, No. 5, pp. 44-54. As for the triflate, examples of the structural formula include $X(OSO_2CF_3)_3$, wherein X is a rare earth element. Among the rare earth elements, X is preferably, for example, scandium (Sc), yttrium (Y), ytterbium (Yb) or samarium (Sm).

The hydrolase is not particularly limited as long as it catalyzes an ester synthesis reaction. Examples of the hydrolase include an esterase classified into EC (enzyme code) group 3.1 (see, for example, Maruo and Tamiya (supervisors), Koso Handbook (Handbook of Enzyme), Asakura-Shoten (1982)) such as carboxyesterase, lipase, phospholipase, acetylesterase, pectinesterase, cholesterol esterase, tannase, monoacylglycerol lipase, lactonase and lipoprotein lipase; a hydrolase classified into EC group 3.2 having activity on a glycosyl compound, such as glucosidase, galactosidase, glucuronidase and xylosidase; a hydrolase classified into EC group 3.3 such as epoxide hydrase; a hydrolase classified into EC group 3.4 having activity on a peptide bond, such as aminopeptidase, chymotrypsin, trypsin, plasmin and subtilisin; and a hydrolase classified into EC group 3.7 such as phloretin hydrase.

Among those esterases, an enzyme of hydrolyzing a glycerol ester and isolating a fatty acid is called a lipase. The lipase is advantageous in that, for example, this enzyme shows high stability in an organic solvent, catalyzes an ester synthesis reaction with good efficiency and is inexpensive. Accordingly, from the aspect of yield and cost, a lipase is preferably used also in the production process of a polyester of the present invention.

Lipases of various origins may be used, but preferred examples thereof include a lipase obtained from micro-organisms of *Pseudomonas* group, *Alcaligenes* group, *Achromobacter* group, *Candida* group, *Aspergillus* group, *Rizopus* group and *Mucor* group, a lipase obtained from plant seeds and a lipase obtained from animal tissues, and further include pancreatin and steapsin. Among these, preferred is a lipase originated in microorganisms of *Pseudomonas* group, *Candida* group and *Aspergillus* group.

One of these polycondensation catalysts may be used alone or a plurality thereof may be used in combination. Furthermore, such a catalyst may be recovered and regenerated, if desired.

The dispersion step in the present invention is a step of dispersing the polyester having an addition-polymerizable unsaturated group at the terminal, in an aqueous medium.

In the dispersion step of the present invention, the dispersion is preferably performed by adding a surfactant or the like so as to elevate the dispersion efficiency or enhance the stability of the resin particle liquid dispersion.

Examples of the method for dispersing the polyester in an aqueous medium and forming it into particles include a known mechanical resin pulverization method, and a method which is performed in an aqueous medium at the production of the polyester as described above, such as suspension-polymerization method, solution-suspension method, mini-emulsion method, microemulsion method, multi-step swelling method and emulsion-polymerization method containing seed polymerization.

In the present invention, the dispersion medium for the resin particle liquid dispersion is an aqueous medium.

Examples of the aqueous medium which can be used in the present invention include water such as distilled water and ion exchanged water, and alcohols such as ethanol and methanol. Among these, ethanol and water are preferred, and water such as distilled water and ion exchanged water is more preferred. One of these aqueous mediums may be used alone or two or more thereof may be used in combination.

Also, the aqueous medium may contain a water-miscible organic solvent. Examples of the water-miscible organic solvent include acetone and acetic acid.

The amount in terms of solid content of the dispersion medium for the resin particle liquid dispersion of the present invention is preferably from about 5 to about 40 parts by weight, more preferably from about 10 to about 30 parts by mass, and most preferably from about 15 to about 25 parts by weight. When the amount in terms of solid content of the resin particle liquid dispersion is about 5 parts by weight or more, the viscosity of the polymer composition is not excessively decreased and this is preferred because of good stability of particles as well as in view of cost at the transportation, and when the amount in terms of solid content is about 40 parts by weight or less, an appropriate viscosity results to allow for uniform stirring and therefore, satisfactory progress of polymerization is advantageously ensured.

At such polymerization in an aqueous medium, a colorant, a wax and the like may be previously mixed to the monomer components before polymerization. This makes it possible to obtain a polymerizable composite particle where a colorant or a wax is incorporated.

Also, in the production process of a resin particle liquid dispersion of the present invention, in the case of performing emulsion-polycondensation in an aqueous medium, by taking account of energy saving, polymer production rate, and thermal decomposition rate of the produced polymer, the emulsification temperature is preferably lower and is preferably from about 40 to about 150° C., more preferably from about 80 to about 130° C. When the emulsification temperature is about 150° C. or less, this is preferred because an excessively high energy is not required and reduction in the molecular weight ascribable to the decomposition of resin due to high heat does not occur, and when it is about 40° C. or more, the viscosity of resin is appropriate and microparticulation is advantageously facilitated.

The method for dispersing the polyester in an aqueous medium may be also selected from known methods such as forced emulsification method, self-emulsification method and phase-inversion emulsification method. Among these, a self-emulsification method and a phase-inversion emulsification method are preferred in view of the energy required for emulsification, the controllability of particle diameter of the resulting emulsified product, the safety and the like.

The self-emulsification method and phase-inversion emulsification method are described in Chobiryushi Polymer no Oyo Gijutsu (Applied Technology of Ultrafine Particulate Polymer), CMC. As for the polar group used in the self-emulsification method, a carboxyl group, a sulfone group or the like may be used, but when the self-emulsification is applied to the polyester usable in the present invention, a carboxyl group is preferred.

In the case of using an organic solvent in the dispersion step, the production process of a resin particle liquid dispersion of the present invention may contain at least a step of removing a part of the organic solvent and a step of forming a resin particle.

For example, the polyester-containing material after emulsification is preferably solidified as a particle by removing a part of the organic solvent. Specific examples of the method for solidification include a method of, after the emulsion-dispersion of a polycondensed resin-containing material in an aqueous medium, drying the organic solvent at the air-liquid interface by feeding air or an inert gas such as nitrogen while stirring the solution (waste air drying method), a method of performing the drying by keeping the system under reduced pressure while, if desired, bubbling an inert gas (vacuum topping method), and a method of repeatedly ejecting an emulsion-dispersion liquid after the emulsion dispersion of a polycondensed resin-containing material in an aqueous medium or an emulsified liquid of the polycondensed resin-containing material to emerge in the form of a shower from small pores and fall on a dish-like receiver or the like, thereby performing the drying (shower-type solvent removal method). The solvent removal is preferably performed by appropriately selecting these methods individually or in combination according to the evaporation rate, water solubility or the like of the organic solvent used.

The dispersion or emulsification in an aqueous medium is performed by emulsifying or dispersing the materials described above in an aqueous medium by the use of, for example, mechanical shear or ultrasonic wave, and at this emulsion dispersion, a surfactant, a polymer dispersant, an inorganic dispersant and the like may be added to the aqueous medium, if desired. Also, an aqueous medium may be added to a mixture (oil phase) containing the polyester and the monomer having a carboxyl group and an addition-polymerizable unsaturated group so that the polyester and the monomer having a carboxyl group and an addition-polymerizable unsaturated group can be finally emulsion-dispersed in the aqueous medium.

Examples of the surfactant which can be used in the present invention include an anionic surfactant such as sulfuric ester salt type, sulfate type and phosphoric ester type; a cationic surfactant such as amine salt type and quaternary ammonium salt type; and a nonionic surfactant such as polyethylene glycol type, alkylphenol ethylene oxide adduct type and polyhydric alcohol type. Among these, an anionic surfactant and a cationic surfactant are preferred. The nonionic surfactant is preferably used in combination with the anionic surfactant or cationic surfactant. One of these surfactants may be used alone or two or more thereof may be used in combination.

Examples of the anionic surfactant include sodium dodecylbenzenesulfonate, sodium alkylnaphthalenesulfonate, sodium arylalkylpolyethersulfonate, sodium 3,3'-disulfonediphenylurea-4,4'-diazobisamino-8-naphthol-6-sulfonate, o-carboxybenzeneazodimethylaniline, sodium 2,2',5,5'-tetra-methyltriphenylmethane-4,4'-diazobis-β-naphthol-6-sulfonate, sodium dialkylsulfosuccinate, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate and calcium oleate.

Examples of the cationic surfactant include alkyl-benzenedimethylammonium chloride, alkyltrimethylammonium chloride and distearylammonium chloride.

Examples of the nonionic surfactant include a polyethylene oxide, a polypropylene oxide, a combination of polypropylene oxide and polyethylene oxide, an ester of polyethylene glycol and higher fatty acid, an alkylphenol polyethylene oxide, an ester of higher fatty acid and polyethylene glycol, an ester of higher fatty acid and polypropylene oxide, and a sorbitan ester.

Examples of the polymer dispersant include sodium polycarboxylate and polyvinyl alcohol, and examples of the inorganic dispersant include calcium carbonate, but the present invention is in no way limited thereto.

Furthermore, higher alcohols as represented by heptanol and octanol, and/or higher aliphatic hydrocarbons as represented by hexadecane, may also be usually blended as a stabilization aid so as to prevent the Ostwald ripening phenomenon of the emulsion particle in an aqueous medium.

<Co-Surfactant>

In the present invention, a co-surfactant may be used in combination so as to keep the average particle diameter of an oil phase containing the above-described monomer to fall within a specific range. As for the co-surfactant, a co-surfactant being insoluble or sparingly soluble in water and soluble in the monomer and being used in the conventionally known "miniemulsion polymerization" which is described later, may be used. Suitable examples of the co-surfactant include alkanes having a carbon number of 8 to 30, such as dodecane, hexadecane and octadecane; alkyl alcohols having a carbon number of 8 to 30, such as lauryl alcohol, cetyl alcohol and stearyl alcohol; alkyl(meth)acrylates having a carbon number of 8 to 30, such as lauryl(meth)acrylate, cetyl(meth)acrylate and stearyl(meth)acrylate; alkanethiols having a carbon number of 8 to 30, such as dodecanethiol, lauryl mercaptan, cetyl mercaptan and stearyl mercaptan; polymers or polyadducts such as polystyrene and polymethyl methacrylate; carboxylic acids; ketones; and amines.

Here, in the formation of an emulsion, for example, a monomer solution after a co-surfactant is added thereto and an aqueous surfactant solution are uniformly mixed and emulsified in a shear mixing apparatus such as piston homogenizer, microfluidizing device (e.g., "Microfluidizer" manufactured by Microfluidics) and ultrasonic disperser. At this time, the amount of the monomer charged into water is approximately from about 0.1 to about 50 wt % based on the total amount of the monomer and water, and the amount of the surfactant used is preferably less than the critical micelle concentration (CMC) in the presence of the emulsion formed. Also, the amount of the co-surfactant used is preferably from about 0.1 to about 40 parts by weight, more preferably from about 0.1 to about 10 parts by weight, per 100 parts by weight of the monomer.

In the present invention, the addition-polymerization step is a step of polycondensing the addition-polymerizable unsaturated group in the polyester having an addition-polymerizable unsaturated group at the terminal.

In the addition-polymerization step of the present invention, the method for addition-polymerizing a polyester terminal-modified by the monomer having a carboxyl group and an addition-polymerizable unsaturated group is not particularly limited but is preferably a polymerization method of dispersing the polyester in an aqueous medium and effecting the addition-polymerization. The polymerization method in an aqueous medium can utilize an ordinary polymerization mode in an aqueous medium, such as suspension-polymerization method, solution-suspension method, miniemulsion method, microemulsion method, multi-step swelling method, emulsion-polymerization method containing seed polymerization. In this case, as described above, the polycondensation reaction, particularly final molecular weight or polymerization rate, depends on the final particle diameter and therefore, a polymerization method of giving a submicron particle as the final form, such as miniemulsion method and microemulsion method, is most preferred as the method ensuring that a most preferred particle form of about 1 μm or less and efficient production are achieved.

<Addition Polymerization Initiator>

As for the polymerization method of the addition-polymerizable monomer, a method using a radical, cationic or anionic polymerization initiator, a self-polymerization method under heat, a method using ultraviolet irradiation and a known polymerization method may be employed. The radical, cationic or anionic polymerization initiator may be a known initiator, and one initiator may be used alone or two or more kinds of initiators may be used in combination.

The radical initiator includes an oil-soluble initiator and a water-soluble initiator, and either initiator may be used.

Specific examples of the radical initiator include organic peroxides such as azobisnitriles (e.g., 2,2'-azobis(2-methylpropionitrile), 2,2'-azobis(2-methylbutyro-nitrile), 2,2'-azobisisobutyronitrile, 2,2'-azobis(2,4-dimethylvaleronitrile), 2,2'-azobis(2,4-dimethyl-4-methoxy-valeronitrile), 1,1'-azobis(cyclohexanecarbonitrile), 2,2'-azobis(2-amidinopropane)hydrochloride), diacyl peroxide (e.g., acetyl peroxide, octanoyl peroxide, 3,5,5-trimethyl-hexanoyl peroxide, decanoyl peroxide, lauroyl peroxide, benzoyl peroxide), dialkyl peroxide (e.g., di-tert-butyl peroxide, tert-butyl-α-cumyl peroxide, dicumyl peroxide), peroxyester (e.g., tert-butyl peroxyacetate, α-cumyl peroxypivalate, tert-butyl peroxyoctoate, tert-butyl peroxyneodecanoate, tert-butyl peroxylaurate, tert-butyl peroxybenzoate, di-tert-butyl peroxyphthalate, di-tert-butyl peroxyisophthalate), hydroperoxide (e.g., tert-butyl hydroperoxide, 2,5-dimethylhexane-2,5-dihydroperoxide, cumene hydroperoxide, diisopropylbenzene hydroperoxide) and peroxycarbonate (e.g., tert-butyl peroxyisopropyl-carbonate); inorganic peroxides such as hydrogen peroxide; and persulfates such as potassium persulfate, sodium persulfate and ammonium persulfate. Also, a known redox polymerization initiator may be used in combination.

Incidentally, the polymerization of the monomer emulsion in the present invention by using a surfactant in an amount less than the critical micelle concentration (CMC) and using a co-surfactant in combination is known as so-called "miniemulsion polymerization", and this is described, for example, in P. L. Tang, E. D. Sudol, C. A. Silebi and M. S. El-Aasser, J. Appl. Polym. Sci., Vol. 43, page 1059 (1991). In the conventional emulsion polymerization where an aqueous emulsion comprising monomer particles having a particle diameter of about several μm is polymerized by using a water-soluble polymerization initiator in the presence of a surfactant in an amount not less than the critical micelle concentration (CMC), the polymerization is initiated in the surfactant micelle and the polymer particle is grown and formed with the supply of the monomer diffusing from the monomer particle. On the other hand, in the "miniemulsion polymerization", the monomer is polymerized in the monomer particle and therefore, a uniform polymer particle is formed. Furthermore, the "miniemulsion polymerization" of a polyester/addition-polymerization type resin composite polymer as in the present invention is advantageous in that since diffusion of the monomer is not required in the polymerization process, the polyester can be present as it is in the polymer particle.

Also, so-called "microemulsion polymerization" of producing particles having a particle diameter of 5 to 50 nm described, for example, in J. S. Guo, M. S. El-Aasser, and J. W. Vanderhoff, J. Polym. Sci.: Polym. Chem. Ed., Vol. 27, page 691 (1989) has a dispersion structure and a polymerization mechanism similar to the "miniemulsion polymerization" as referred to in the present invention, but in the "microemulsion polymerization", a surfactant is used in a large amount more than the critical micelle concentration (CMC) and there may arise a problem, for example, a large amount of a surfactant is mingled into the obtained polymer fine particle or a huge time is necessary for the step of removing the surfactant, such as water washing, acid washing or alkali washing.

In the resin particle liquid dispersion of the present invention, the solid content in the aqueous medium is preferably from about 5 to about 50 parts by weight, more preferably from about 10 to about 40 parts by weight. When the solid content is about 50 parts by weight or less, the latex has good flowability and is advantageously free from alteration into the creamy mousse state due to storage conditions, and when it is about 5 wt % or more, the liquid dispersion does not come to occupy a large proportion in the entire composition at the production of a toner by using the liquid dispersion and this is preferred because the preparation of the composition is facilitated and the transportation cost can be suppressed.

(Electrostatic Image Developing Toner and Production Process Thereof)

The production process of an electrostatic image developing toner (hereinafter sometimes simply referred to as a "toner") of the present invention is a process for producing an electrostatic image developing toner, comprising a step of aggregating resin particles in a liquid dispersion containing at least a resin particle liquid dispersion to obtain aggregate particles, and a step of heating and thereby coalescing the aggregate particles, wherein the resin particle liquid dispersion is the resin particle liquid dispersion of the present invention.

In the production process of an electrostatic image developing toner of the present invention, the above-described polyester-containing addition-polymerizable monomer emulsion is subjected to polymerization of the monomer in the presence of a polymerization initiator to form a polyester/addition-polymerization type resin polymer particle which is a composite resin particle of polyester and addition-polymerization type resin. Subsequently, the formed polymer particles are aggregated (associated) by a known particle aggregating and coalescing method such as aggregation method, whereby the particle diameter and particle diameter distribution of the toner can be adjusted. For example, this adjustment of the toner particle in the emulsion polymerization-aggregation method is achieved typically by mixing the composite resin particle liquid dispersion of polyester/addition-polymerization type resin prepared in the present invention with a colorant particle liquid dispersion and a releasing agent particle liquid dispersion, adding a coagulant to generate hetero-aggregation and thereby form an aggregate particle having a toner size, and fusing and coalescing the aggregate particles under heating at a temperature higher than the glass transition point or melting point of the resin particle, followed by washing and drying. As for the toner shape, a toner from amorphous to spherical is preferably used. Also, as for the coagulant, in addition to a surfactant, an inorganic salt and a divalent or higher-valent metal salt can be suitably used. Particularly, a metal salt is preferred in view of aggregation control and toner chargeability In the aggregation step, after a resin particle liquid dispersion containing the polyester resin of the present invention and a colorant particle liquid dispersion are previously aggregated to form a first aggregate particle, the resin particle liquid dispersion containing the polyester of the present invention or another polymer particle liquid dispersion may be further added to form a second shell layer on the surface of the first particle. In this example, a colorant liquid dispersion is separately prepared, but a colorant may be of course previously blended with the resin particle in the resin particle liquid dispersion of the present invention.

In the present invention, the aggregation method for the colorant-containing resin particle obtained by the above-described polymerization is not particularly limited, and a conventionally known aggregation method employed in the emulsion polymerization-aggregation method of an electrostatic image developing toner, such as a method of reducing the stability of emulsion, for example, by the elevation of temperature, change of pH or addition of salt and then stirring the emulsion with a disperser or the like, may be used.

After the aggregation treatment, for the purpose of, for example, suppressing the bleed-out of the colorant from the particle surface, a heat treatment or the like may be applied to thereby crosslink the particle surface. The surfactant and the like used may be removed by washing such as water washing, acid washing or alkali washing, if desired.

In the production process of an electrostatic image developing toner of the present invention, a charge control agent used for this type of toner may be used, if desired. In this case, the charge control agent may be formed into an aqueous liquid dispersion or the like, for example, at the production initiation of the monomer particle emulsion, at the initiation of polymerization or at the aggregation initiation of the resin particle. The charge control agent is preferably added in an amount of about 1 to about 25 parts by weight, more preferably from about 5 to about 15 parts by weight, per 100 parts by weight of the monomer or polymer.

The charge control agent may be a known charge control agent, for example, a positive charging charge control agent such as nigrosine-based dye, quaternary ammonium salt-based compound, triphenylmethane-based compound, imidazole-based compound and polyamine-based resin, or a negative charging charge control agent such as metal (e.g., chromium, cobalt, aluminum, iron)-containing azo-based dye, metal (e.g., chromium, zinc, aluminum) salt or complex of hydroxycarboxylic acid (e.g., salicylic acid, alkylsalicylic acid, benzilic acid), amide compound, phenol compound, naphthol compound and phenolamide compound.

Also, in the production process of an electrostatic image developing toner of the present invention, waxes as a releasing agent used for this type of toner may be used, if desired. In this case, the releasing agent may be added in the form of an aqueous liquid dispersion or the like, for example, at the production initiation of the monomer emulsion, at the initiation of polymerization or at the aggregation initiation of the polymer particle. The releasing agent is preferably used in an amount of about 1 to about 25 parts by weight, more preferably from about 5 to about 15 parts by weight, per 100 parts by weight of the monomer or polymer.

The releasing agent may be a known releasing agent, for example, a polyolefin-based wax such as low molecular polyethylene, low molecular polypropylene and an ethylene-propylene copolymer; a vegetable wax such as paraffin-based wax, hydrogenated castor oil, carnauba wax and rice wax; a higher fatty acid ester-based wax such as stearic acid ester, behenic acid ester and montanic acid ester; an alkyl-modified silicone; a higher alcohol of stearic acid or the like, such as higher fatty acid stearyl alcohol; a higher fatty acid amide such as oleic acid amide and stearic acid amide; and a ketone having a long-chain alkyl group, such as distearyl ketone.

Furthermore, in the production process of an electro-static image developing toner of the present invention, various known internal additives such as antioxidant and ultraviolet absorbent used for this type of toner may be used, if desired.

The toner obtained by the production process of an electrostatic image developing toner of the present invention preferably has an average particle diameter of about 1 to about 10 μm, and the toner particle preferably contains a colorant in an amount of about 0.1 to about 50 parts by weight, more preferably from about 0.5 to about 40 parts by weight, still more preferably from about 1 to about 25 parts by weight, per 100 parts by weight of the binder resin.

<Colorant>

Examples of the colorant usable in the toner of the present invention include various pigments such as carbon black, chrome Yellow, Hansa Yellow, benzidine yellow, Threne Yellow, quinoline yellow, Permanent Orange GTR, pyrazolone orange, Vulcan Orange, Watchung Red, Permanent Red, Brilliant Carmine 3B, Brilliant Carmine 6B, DuPont Oil Red, pyrazolone red, Lithol Red, Rhodamine B Lake, Lake Red C, Rose Bengal, aniline blue, ultramarine blue, Calco Oil Blue, methylene blue chloride, phthalocyanine blue, phthalocyanine green, Malachite Green Oxalate and titanium black; and various dyes such as acridine type, xanthene type, azo type, benzoquinone type, azine type, anthraquinone type, thioindigo type, dioxazine type, thiazine type, azomethine type, indigo type, thioindigo type, phthalocyanine type, aniline black type, polymethine type, triphenylmethane type, diphenylmethane type, thiazine type, thiazole type, and xanthene type. Specific examples of the colorant which can be suitably used include carbon black, Nigrosine Dye (C.I. No. 50415B), Aniline Blue (C.I. No. 50405), Calco Oil Blue (C.I. No. azoic Blue 3), Chrome Yellow (C.I. No. 14090), Ultramarine Blue (C.I. No. 77103), DuPont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengal (C.I. No. 45435), and a mixture thereof.

The amount used of the colorant is usually from about 0.1 to about 20 parts by weight, preferably from about 0.5 to about 10 parts by weight, per 100 parts by weight of the toner. Also, one of these pigments, dyes and the like may be used alone as the colorant, or two or more thereof may be used in combination.

The method for dispersing the colorant is not particularly limited, and an arbitrary method, for example, a general dispersing method such as rotation shearing homogenizer, media-containing ball mill, sand mill or dynomill, may be used. Also, the colorant fine particle may be added in a mixed solvent together with other fine particle components at a time or in parts at multiple stages.

The electrostatic image developing toner of the present invention may contain a magnetic material or a characteristic improving agent, if desired.

Examples of the magnetic material include a metal or alloy exhibiting ferromagnetic property, such as iron, cobalt and nickel, including ferrite and magnetite; a compound containing such an element; an alloy containing no ferromagnetic element but caused to exhibit ferromagnetic property when subjected to an appropriate heat treatment, for example, an alloy of the type called Whisler alloy containing manganese and copper, such as manganese-copper-aluminum and manganese-copper-tin; and chromium dioxide. For example, in the case of obtaining a black toner, magnetite which is black itself and exerts a function as a colorant may be preferably used. Also, in the case of obtaining a color toner, a magnetic material with little blackish tint, such as metallic iron, is preferred. Some of these magnetic materials function as a colorant and in such a case, the magnetic material may be used to serve also as the colorant. The content of such a magnetic material is, in the case of a magnetic toner, preferably from about 20 to about 70 parts by weight, more preferably from about 40 to about 70 parts by weight, per 100 parts by weight of the toner.

The characteristic improving agent includes a fixing property enhancer, a charge control agent and others.

Examples of the fixing property enhancer which can be used include a polyolefin, a fatty acid metal salt, a fatty acid ester, a fatty acid ester-based wax, a partially saponified fatty acid ester, a higher fatty acid, a higher alcohol, a fluid or solid paraffin wax, a polyamide-based wax, a polyhydric alcohol ester, a silicon varnish and an aliphatic fluorocarbon. In particular, a wax having a softening point (by the ring and ball method, JIS K2207:96) of about 60 to about 150° C. is preferred.

As for the charge control agent, a conventionally known charge control agent may be used, and examples thereof include a nigrosine-based dye and a metal-containing dye.

The toner of the present invention is preferably used after mixing an inorganic fine particle of a flowability enhancer or the like therein.

The inorganic fine particle for use in the present invention is a particle having a primary particle diameter of about 5 nm to about 2 μm, preferably from about 5 to about 500 nm. Also, the specific surface area by the BET method is preferably from about 20 to about 500 $m^2/g$. The proportion of the inorganic particle mixed in the toner is from about 0.01 to about 5 wt %, preferably from about 0.01 to about 2.0 wt %. Examples of this inorganic particle include silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Among these, silica powder is preferred.

The silica powder as used herein means a powder having an Si—O—Si bond and includes both a silica powder produced by the dry process and a silica powder produced by the wet process. Also, the silica powder may be any of anhydrous silicon dioxide, aluminum silicate, sodium silicate, potassium silicate, magnesium silicate, zinc silicate and the like, but a silica powder containing about 85 wt % or more of $SiO_2$ is preferred.

Specific examples of the silica powder include commercially available various silicas, but those having a hydrophobic group on the surface are preferred, such as AEROSIL R-972, R-974, R-805 and R-812 (all produced by Aerosil Co.), and Talax 500 (produced by Talco Co.). Other than these, for example, a silica powder treated with a silane coupling agent, a titanium coupling agent, a silicon oil, a silicon oil having an amine in the side chain, or the like, may be used.

The toner obtained by the production process of an electrostatic image developing toner of the present invention preferably has an accumulated volume average particle diameter ($D_{50}$) of about 3.0 to about 9.0 μm, more preferably from about 3.0 to about 5.0 μm. When $D_{50}$ is about 3.0 μm or more, appropriate adhesive force and good developability are advantageously obtained, and when $D_{50}$ is about 9.0 μm or less, the resolution of image is excellent and this is preferred.

The volume average particle size distribution index GSDv of the toner obtained is preferably about 1.30 or less. When the GSDv is about 1.30 or less, excellent resolution can be obtained and scattering of toner or image defect such as fogging is advantageously not caused.

The accumulated volume average particle diameter $D_{50}$ and the average particle size distribution index are determined as follows. Respective cumulative distributions of volume and number are drawn from the small diameter side with respect to the divided particle size range (channel) based on the particle size distribution measured by a measuring meter such as Coulter Counter TAII (manufactured by Coulter Co., Ltd.) or Multisizer II (manufactured by Coulter Co., Ltd.). The particle size at 16% accumulation is defined as $D_{16V}$ for volume and $D_{16P}$ for number, the particle size at 50% accumulation is defined as $D_{50V}$ for volume and $D_{50P}$ for number, and the particle size at 84% accumulation is defined as $D_{84V}$ for volume and $D_{84P}$ for number. Using these values, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

In view of image forming property, the shape factor SF1 of the toner obtained is preferably from about 100 to about 140, more preferably from about 110 to about 135.

The shape factor SF1 is digitized mainly by analyzing a microscopic image or a scanning electron microscopic image and, for example, determined as follows. An optical microscopic image of the toner scattered on a slide glass is input into a Luzex image analyzer through a video camera, SF1 is calculated for 50 or more toner particles according to the following formula, and its average value is obtained.

$$SF1 = \frac{(ML)^2}{A} \times \frac{\pi}{4} \times 100$$

wherein ML is an absolute maximum length of the toner particle and A is a projected area of the toner particle.

The toner obtained is dried in the same manner as a normal toner and before use, for the purpose of imparting flowability and enhancing the cleaning property, an inorganic particle such as silica, alumina, titania and calcium carbonate, or a resin particle such as vinyl-based resin, polyester and silicone, may be added to the toner particle surface while applying shear in the dry state.

In the case attaching the inorganic particle or resin particle to the toner surface in an aqueous medium, as for the inorganic particle, all materials usually employed as the external additive to the toner surface, such as silica, alumina, titania, calcium carbonate, magnesium carbonate and tricalcium phosphate, may be used after dispersing such a material with an ionic surfactant, a polymer acid or a polymer base.

(Electrostatic Image Developer)

The toner obtained by the production process of an electrostatic image developing toner of the present invention may be used as an electrostatic image developer. This developer is not particularly limited as long as it contains the above-described electrostatic image developing toner, and may take an appropriate component composition according to the purpose. When the electrostatic image developing toner is used alone, the developer is prepared as a one-component system electrostatic image developer, and when the toner is used in combination with a carrier, the developer is prepared as a two-component system electrostatic image developer.

The carrier usable in the present invention is not particularly limited, but examples of the carrier usually employed include a magnetic particle such as iron powder, ferrite, iron oxide powder and nickel; a resin-coated carrier obtained by coating the surface of a magnetic particle as a core material with a resin such as styrene-based resin, vinyl-based resin, ethylene-based resin, rosin-based resin, polyester-based resin and melamine-based resin or with a wax such as stearic acid to form a resin coat layer; and a magnetic material dispersion-type carrier obtained by dispersing magnetic particles in a binder resin. Among these, a resin-coated carrier is preferred because the toner chargeability or the resistance of the entire carrier can be controlled by the constitution of the resin coat layer.

The mixing ratio between the toner of the present invention and the carrier in the two-component system electrostatic image developer is usually from about 2 to about 10 parts by weight of toner per 100 parts by weight of carrier. The preparation method of the developer is not particularly limited, but examples thereof include a method of mixing the toner and the carrier by a V blender or the like.

(Image Forming Method)

The image forming method of the present invention is an image forming method comprising a latent image-forming step of forming an electrostatic latent image on the surface of a latent image holding member, a development step of developing the electrostatic latent image formed on the surface of a latent image holding member with a developer containing a toner to form a toner image, a transfer step of transferring the toner image formed on the surface of a latent image holding member to the surface of a transferee member, and a fixing step of heat-fixing the toner image transferred to the surface of a transferee member, wherein the electrostatic image developing toner of the present invention is used as the toner, or the electrostatic image developer of the present invention is used as the developer.

In the image forming method of the present invention, a developer is prepared by using the above-described specific toner, an electrostatic image is formed and developed in a normal electrophotographic copying machine by using the developer, and the toner image obtained is electrostatically transferred onto a transfer paper and then fixed by a heat roller fixing device with the heat roller temperature being set to a constant temperature, whereby a copy image is formed.

The image forming method of the present invention is preferably used particularly in performing high-speed fixing where the contact time between the toner on transfer paper and the heat roller is within about 1 second, more preferably within about 0.5 seconds.

The electrostatic image developer (electrostatic image developing toner) may also be used for the image forming method in a normal electrostatic image developing system (electrophotographic system). The image forming method of the present invention specifically comprises, for example, an electrostatic latent image-forming step, a toner image-forming step, a transfer step and a cleaning step. These steps all are a generally employed step and described, for example, in JP-A-56-40868 and JP-A-49-91231. Incidentally, the image forming method of the present invention may be performed by using a known image forming apparatus such as copying machine and facsimile machine.

The electrostatic latent image-forming step is a step of forming an electrostatic latent image on an electrostatic image carrier. The toner image-forming step is a step of developing the electrostatic latent image with a developer layer on a developer carrier to form a toner image. The developer layer is not particularly limited as long as it contains the electrostatic image developer of the present invention containing the electrostatic image developing toner of the present invention. The transfer step is a step of transferring the toner image on a transfer material. The cleaning step is a step of removing the electrostatic image developer remaining on the electrostatic latent image carrier. In a preferred embodiment, the image forming method of the present invention further comprises a recycling step. The recycling step is a step of returning the electrostatic image developing toner recovered in the cleaning step to the developer layer. The image forming method in this embodiment comprising a recycling step can be performed by using an image forming apparatus such as toner recycling system-type copying machine or facsimile machine. The image forming method of the present invention may also be applied to a recycling system where the cleaning step is omitted and the toner is recovered simultaneously with the development.

EXAMPLES

The present invention is described in greater detail below by referring to Examples, but the present invention is not limited to these Examples. In Examples, unless otherwise indicated, the "parts" indicates "parts by weight".

The toners of Examples each is produced as follows. The following resin particle liquid dispersion, colorant particle liquid dispersion and releasing agent particle liquid dispersion are separately prepared and mixed at a predetermined ratio. A polymer of metal salt is added thereto with stirring to effect ionic neutralization and form aggregate particles, and an inorganic hydroxide is then added to adjust the pH in the system from weakly acidic to neutral. Subsequently, the system is heated at a temperature higher than the glass transition point or melting point of the resin particle, thereby fusing and coalescing the aggregate particles. After the completion of reaction, a desired toner is obtained through the steps of thorough washing, solid-liquid separation and drying. Respective preparation methods and measuring methods of characteristic values are described below.

<Measurement of Melting Point and Glass Transition Point>

The measurement is performed according to the differential scanning calorimetry (DSC) by using "DSC-20" (manufactured by Seiko Instruments & Electronics Ltd.), where about 10 mg of a sample is heated at a constant temperature rising rate (10° C./min) and the melting point is determined from the base line and the heat absorption peak.

<Measurement of Weight Average Molecular Weight Mw and Number Average Molecular Weight Mn>

As for the values of the weight average molecular weight Mw and the number average molecular weight Mn, the weight average molecular weight Mw and the number average molecular weight Mn are measured by gel permeation chromatography (GPC) under the conditions described below. The measurement is performed at a temperature of 40° C. by flowing a solvent (tetrahydrofuran) at a flow velocity of 1.2 ml/min, and injecting 3 mg as the sample weight of a tetrahydrofuran sample solution having a concentration of 0.2 g/20 ml. At the measurement of the molecular weight of a sample, the measurement conditions are selected such that the molecular weight of the sample is included in the range where the logarithm of a molecular weight in a calibration curve created from several kinds of monodisperse polystyrene standard samples and the counted number form a straight line.

In this connection, the reliability of the measurement results can be confirmed from the fact that when an NBS706 polystyrene standard sample is measured under the above-described conditions, weight average molecular weight $Mw=28.8\times10^4$ number average molecular weight $Mn=13.7\times10^4$ As for the column of GPC, TSK-GEL, GMH (produced by Tosoh Corp.) is used.

The solvent and the measurement temperature are changed to appropriate conditions according to the sample measured.

Incidentally, in the case where a resin particle liquid dispersion using an aromatic-containing monomer as the addition-polymerizable resin is produced by using an aliphatic polyester as the polyester, at the analysis of both molecular weights, each molecular weight may also be analyzed by post-mounting an apparatus of separating UV and RI, as the detector.

Example 1

Production of Amorphous Resin Particle Liquid Dispersion (A1)

| | |
|---|---|
| 1,4-Cyclohexanedicarboxylic acid | 175 parts by weight |
| Bisphenol A-ethylene oxide (1 mol) adduct | 210 parts by weight |
| Bisphenol A-propylene oxide (1 mol) adduct | 100 parts by weight |
| Dodecylbenzenesulfonic acid | 0.35 parts by weight |

These materials are mixed and charged into a 2,000 ml-volume reactor equipped with a stirrer, and poly-condensation is performed at 120° C. for 7 hours in a nitrogen atmosphere. After the polymerization time of 7 hours, 20 parts by weight of 2-carboxyethyl acrylate (β-CEA, produced by Rhodia) is added, and the polycondensation is further performed for 3 hours, as a result, a uniform and transparent amorphous polyester resin is obtained. The weight average molecular weight by GPC is 16,000, the glass transition temperature (on-set) is 57° C., and the resin acid value is 31 mg·KOH/g.

This resin is sampled in a small amount for the analysis, dissolved in tetrahydrofuran (THF), reprecipitated in water and dried to obtain a polymer. When NMR is measured, a peak assignable to the β-CEA terminal is obtained in the vicinity of 4.5 ppm. For comparison, a polyester is produced thoroughly in the same manner except for not using β-CEA in the composition above, but the above-described peak is not observed from this sample.

To 100 parts by weight of the resin obtained above, 0.5 parts by weight of sodium n-dodecylbenzenesulfonate is added as the surfactant, and 300 parts by weight of ion exchanged water is further added. The resulting solution is heated at 90° C. and simultaneously with the heating, thoroughly mixed and dispersed by a homogenizer (Ultra-Turrax T50, manufactured by IKA Works, Inc.) in a round glass-made flask. Thereafter, the pH in the system is adjusted to 7.5 with 0.5 mol/liter of an aqueous sodium hydroxide solution and while continuing the stirring by the homogenizer, the dispersion is heated to 95° C. Subsequently, 0.5 parts by weight of potassium persulfate is added as the initiator, and the reaction is further continued at 90° C. for 5 hours to obtain a resin particle liquid dispersion of copolymer resin. Amorphous Resin Particle Liquid Dispersion (A1) where the center diameter of the resin particle is 280 nm and the solid content is 20%, is obtained. This liquid dispersion is dried and analyzed, as a result, the weight average molecular weight by GPC is 18,000, the glass transition temperature (on-set) is 53° C., and the resin acid value is 34 mg·KOH/g.

Example 2

Production of Amorphous Resin Particle Liquid Dispersion (A2)

| | |
|---|---|
| 1,4-Phenylenediacetic acid | 222 parts by weight |
| Bisphenol A-propylene oxide (1 mol) adduct | 200 parts by weight |
| Bisphenol A-ethylene oxide (1 mol) adduct | 86 parts by weight |
| Cyclohexanedimethanol | 83 parts by weight |
| p-Toluenesulfonic acid | 0.7 parts by weight |

These materials are mixed and charged into a 2,000 ml-volume reactor equipped with a stirrer, and polycondensation is performed at 120° C. for 7 hours in a nitrogen atmosphere. After 7 hours, 18 parts by weight of acrylic acid oligomer (trimer to pentamer of acrylic acid) is added, and the polycondensation is further performed for 3 hours, as a result, a uniform and transparent amorphous polyester resin is obtained. The weight average molecular weight by GPC is 12,800, the glass transition temperature (on-set) is 55° C., and the resin acid value is 20 mg·KOH/g. When NMR is measured, a peak is observed in the vicinity of 4.5 ppm, and it is confirmed that the polyester terminal is capped with an acrylic acid oligomer.

To 100 parts by weight of the resin obtained above, 0.5 parts by weight of sodium n-dodecylbenzenesulfonate is added as the surfactant, and 300 parts by weight of ion exchanged water is further added. The resulting solution is heated at 90° C. and simultaneously with the heating, thoroughly mixed and dispersed by a homogenizer (Ultra-Turrax T50, manufactured by IKA Works, Inc.) in a round glass-made flask. Thereafter, the pH in the system is adjusted to 7.5 with 0.5 mol/liter of an aqueous sodium hydroxide solution and while continuing the stirring by the homogenizer, the dispersion is heated to 95° C. Subsequently, 0.5 parts by weight of potassium persulfate is added as the initiator, and the reaction is further continued at 90° C. for 5 hours to obtain a resin particle liquid dispersion of copolymer resin. Amorphous Resin Particle Liquid Dispersion (A2) where the center diameter of the resin particle is 350 nm and the solid content is 20% is obtained. This liquid dispersion is dried and analyzed, as a result, the weight average molecular weight by GPC is 14,000, the glass transition temperature (on-set) is 52° C., and the resin acid value is 24 mg·KOH/g.

Example 3

Production of Crystalline Resin Particle Liquid Dispersion (C1)

| | |
|---|---|
| Dodecylbenzenesulfonic acid | 0.36 parts by weight |
| 1,6-Hexanediol | 59 parts by weight |
| Dodecanoic diacid | 101 parts by weight |

These materials are mixed in a 500 ml-volume flask, and when the mixture is melted under heating at 130° C. by a mantle heater and then held at 80° C. for 4 hours while degassing with stirring by a three-one motor, the contents became a viscous melt. Thereafter, 20 parts by weight of 2-carboxyethyl acrylate (β-CEA, produced by Rhodia) is added, and the polycondensation is further performed for 3 hours, as a result, a uniform and transparent crystalline polyester resin is obtained. The weight average molecular weight by GPC is 22,000, the melting point is 72° C., and the resin acid value is 16 mg·KOH/g. Also, when the analysis by NMR is performed, a peak is observed in the vicinity of 4.5 ppm, and it is confirmed that the polyester terminal is capped with an acrylic acid oligomer. Furthermore, an aqueous solution for neutralization obtained by dissolving 2.0 parts by weight of an aqueous 1N NaOH solution in 650 parts by weight of ion exchanged water heated at 80° C. is charged into the flask and emulsified by a homogenizer (Ultra-Turrax, manufactured by IKA Works, Inc.). Thereafter, 0.5 parts by weight of potassium persulfate is added as the initiator, and the reaction is further continued at 90° C. for 5 hours to obtain a resin particle liquid dispersion of copolymer resin. The flask is then cooled with water at room temperature to obtain Crystalline Polyester Resin Particle Liquid Dispersion (Cl) where the center diameter of the resin particle is 350 nm and the solid content is 20%. This liquid dispersion is dried and analyzed, as a result, the weight average molecular weight by GPC is 23,500, the melting point is 71° C., and the resin acid value is 19 mg·KOH/g.

Example 4

Production of Crystalline Resin Particle Liquid Dispersion (C2)

| | |
|---|---|
| Dodecylbenzenesulfonic acid | 0.6 parts by weight |
| 1,6-Hexanediol | 80 parts by weight |
| Dodecanoic diacid | 115 parts by weight |
| Dimer to pentamer of acrylic acid | 5 parts by weight |

These materials are mixed, and the mixture is melted under heating at 120° C. and charged into the following aqueous solution:

| | |
|---|---|
| Dodecylbenzenesulfonic acid | 2.5 parts by weight |
| Ion exchanged water | 860 parts by weight |

The resulting solution is emulsified by a homogenizer (Ultra-Turrax, manufactured by IKA Works, Inc.) and further emulsified in an ultrasonic bath for 5 minutes, and the emulsified product is kept at 70° C. and held for 15 hours in a flask. Thereafter, 0.5 parts by weight of potassium persulfate is added as the initiator, and the reaction is further continued at 90° C. for 5 hours to obtain Resin Particle Liquid Dispersion (C2) of copolymer resin.

In this way, Resin Particle Liquid Dispersion (C2) where the center diameter of the resin particle is 350 nm, the melting point is 70° C., the weight average molecular weight is 9,800, the acid value is 25 mg·KOH/g and the solid content is 20%, is obtained.

Comparative Example 1

Production of Amorphous Resin Particle Liquid Dispersion (A3)

Amorphous Polyester Resin Particle Liquid Dispersion (A3) where the center diameter of the resin particle is 3,200 nm, the glass transition point is 54° C., the weight average molecular weight is 12,000, the acid value is 8 mg.KOH/g and the solid content is 20%, is obtained thoroughly in the same manner as in Example 1 except for not adding β-CEA and the initiator and performing the emulsification at 100° C.

Comparative Example 2

Production of Amorphous Resin Particle Liquid Dispersion (A4)

| | |
|---|---|
| Dimethyl terephthalate | 155 parts by weight |
| Bisphenol A-ethylene oxide (1 mol) adduct | 210 parts by weight |
| Bisphenol A-propylene oxide (1 mol) adduct | 100 parts by weight |

-continued

| | |
|---|---|
| Fumaric acid | 50 parts by weight |
| Dodecylbenzenesulfonic acid | 0.35 parts by weight |

These materials are mixed and charged into a 2,000 ml-volume reactor equipped with a stirrer, and polycondensation is performed at 120° C. for 7 hours in a nitrogen atmosphere. During the polymerization, the viscosity of the resin is increased and after the polymerization time of 7 hours, a viscous resin component with low transparency is obtained. Furthermore, after 7 hours,

| | |
|---|---|
| Glycidyl methacrylate | 15 parts by weight |
| Methyl methacrylate | 2 parts by weight |
| Acrylic acid | 5 parts by weight |

are added, and the polycondensation is further performed for 3 hours, as a result, an opaque polyester resin is obtained. The weight average molecular weight by GPC is 10,000, the glass transition temperature (on-set) is 41° C., the peak is broad, and the resin acid value is 45 mg·KOH/g.

This resin is sampled in a small amount for the analysis, dissolved in THF, reprecipitated in water and dried to obtain a polymer. When NMR is measured, the peak assignable to fumaric acid disappeared, and a graft of polyester and vinyl resin can be produced.

To 100 parts by weight of this resin, 0.5 parts by weight of sodium n-dodecylbenzenesulfonate is added as the surfactant, and 300 parts by weight of ion exchanged water is further added. The resulting solution is heated at 90° C. and simultaneously with the heating, thoroughly mixed and dispersed by a homogenizer (Ultra-Turrax T50, manufactured by IKA Works, Inc.) in a round glass-made flask. Thereafter, the pH in the system is adjusted to 7.5 with 0.5 mol/liter of an aqueous sodium hydroxide solution and while continuing the stirring by the homogenizer, the dispersion is heated to 95° C. In the obtained resin particle liquid dispersion, the center diameter of the resin particle is 3,400 nm, and an emulsified product is observed as a precipitate. This liquid dispersion is dried and analyzed, as a result, the weight average molecular weight by GPC is 10,000, the glass transition temperature (on-set) is 35° C., and the resin acid value is 39 mg·KOH/g. The solid content is adjusted to 20% to obtain Amorphous Resin Particle Liquid Dispersion (A4).

Comparative Example 3

Production of Crystalline Resin Particle Liquid Dispersion (C3)

| | |
|---|---|
| Benzenesulfonic acid | 0.6 parts by weight |
| 1,6-Hexanediol | 80 parts by weight |
| Sebacic acid | 115 parts by weight |
| SDSP (sodium isophthalic acid-5-sulfonate) | 20 parts by weight |

These materials are mixed and charged into a 2,000 ml-volume reactor equipped with a stirrer, and polycondensation is performed at 120° C. for 7 hours in a nitrogen atmosphere, as a result, a uniform and transparent crystalline polyester resin is obtained. The weight average molecular weight by GPC is 19,000, the melting point is 68° C., and the resin acid value is 55 mg·KOH/g.

To 100 parts by weight of this resin, 0.5 parts by weight of sodium n-dodecylbenzenesulfonate is added as the surfactant, and 300 parts by weight of ion exchanged water is further added. The resulting solution is heated at 90° C. and simultaneously with the heating, thoroughly mixed and dispersed by a homogenizer (Ultra-Turrax T50, manufactured by IKA Works, Inc.) in a round glass-made flask. Thereafter, the pH in the system is adjusted to 7.5 with 0.5 mol/liter of an aqueous sodium hydroxide solution and while continuing the stirring by the homogenizer, the dispersion is heated to 95° C. to obtain Amorphous Resin Particle Liquid Dispersion (C3) where the center diameter of the resin particle is 110 nm and the solid content is 20%.

Comparative Example 4

Production of Amorphous Resin Particle Liquid Dispersion (A5)

| | |
|---|---|
| 1,4-Cyclohexanedicarboxylic acid | 175 parts by weight |
| Bisphenol A-ethylene oxide (1 mol) adduct | 210 parts by weight |
| Bisphenol A-propylene oxide (1 mol) adduct | 100 parts by weight |
| Dodecylbenzenesulfonic acid | 0.35 parts by weight |

These materials are mixed and charged into a 2,000 ml-volume reactor equipped with a stirrer, and polycondensation is performed at 120° C. for 7 hours in a nitrogen atmosphere, as a result, a uniform and transparent amorphous polyester resin is obtained. The weight average molecular weight by GPC is 12,000, the glass transition temperature (on-set) is 54° C., and the resin acid value is 25 mg·KOH/g.

To 100 parts by weight of this resin, 0.5 parts by weight of sodium n-dodecylbenzenesulfonate is added as the surfactant, and 300 parts by weight of ethyl acetate is further dissolved therein to produce a uniform oil phase. Subsequently, water is gradually added to this oil phase, thereby effecting phase inversion emulsification, and the emulsified product is heated at 60° C. and simultaneously with the heating, thoroughly mixed and dispersed by a homogenizer (Ultra-Turrax T50, manufactured by IKA Works, Inc.) in a round glass-made flask while adding water. The stirring by the homogenizer is continued, as a result, a resin particle liquid dispersion of polyester resin is obtained. This liquid dispersion is charged into a rotary evaporator, and the removal of the solvent is continued for 10 hours by reducing the pressure to obtain a liquid dispersion where the center diameter of the resin particle is 180 nm. Thereafter, the solid content is adjusted to 20% to obtain Amorphous Resin Particle Liquid Dispersion (A5).

The physical property values of each resin particle liquid dispersion obtained are shown in Table 1 below.

TABLE 1

| | Resin Particle Liquid Dispersion | Component (a) (mol %) | Component (b) (mol %) | Component (c) (mol %) | Other Monomers | Glass Transition Point or Melting Point (° C.) | Weight Average Molecular Weight | Median Diameter of Resin Particle (nm) | Acid Value (mg · KOH/g) |
|---|---|---|---|---|---|---|---|---|---|
| Example 1 | A1 | 44.7 | 49.2 | 6.1 | none | 53 | 18,000 | 280 | 34 |
| Example 2 | A2 | 40.9 | 56.9 | 2.2 | none | 52 | 14,000 | 350 | 24 |
| Example 3 | C1 | 40.7 | 46.4 | 12.9 | none | 71 | 23,500 | 350 | 19 |
| Example 4 | C2 | 41.7 | 56.5 | 1.7 | none | 70 | 9,800 | 350 | 25 |
| Comparative Example 1 | A3 | 47.6 | 52.4 | none | none | 54 | 12,000 | 3,200 | 8 |
| Comparative Example 2 | A4 | none | 44.0 | 3.5 | dimethyl terephthalate (31.4 mol %, fumaric acid (16.9 mol %), glycidyl methacrylate (4.1 mol %) | 35 | 10,000 | 3,400 | 39 |
| Comparative Example 3 | C3 | 48.7 | 51.3 | none | none | 68 | 19,000 | 110 | 55 |
| Comparative Example 4 | A5 | 47.6 | 52.4 | none | none | 54 | 12,000 | 180 | 25 |

(Preparation of Releasing Agent Particle Liquid Dispersion (W1))

| | |
|---|---|
| Dodecylsulfuric acid | 30 parts by weight |
| Ion exchanged water | 852 parts by weight |
| Palmitic acid | 188 parts by weight |
| Pentaerythritol | 25 parts by weight |

These components are mixed and melted under heating at 250°, and the melt is charged into the aqueous dodecylsulfuric acid solution above, then emulsified by a homogenizer (Ultra-Turrax, manufactured by IKA Works, Inc.) for 5 minutes and further emulsified in an ultrasonic bath for 5 minutes. Thereafter, the emulsified product is kept at 70° C. in a flask with stirring and held for 15 hours.

As a result, Releasing Agent Particle Liquid Dispersion (W1) where the center diameter of releasing agent particle is 310 nm, the melting point is 72° C. and the solid content is 20%, is obtained.

(Preparation of Colorant Particle Liquid Dispersion (P1))

| | |
|---|---|
| Cyan pigment (C.I. Pigment Blue 15:3, produced by Dainichiseika Color & Chemicals Mfg. Co., Ltd.) | 50 parts by weight |
| Anionic surfactant (Neogen R, produced by Dai-ichi Kogyo Seiyaku Co., Ltd.) | 5 parts by weight |
| Ion exchanged water | 200 parts by weight |

These components are mixed, dissolved and then dispersed by a homogenizer (Ultra-Turrax, manufactured by IKA Works, Inc.) for 5 minutes and by an ultrasonic bath for 10 minutes to obtain Cyan Colorant Particle Liquid Dispersion (P1) having a center diameter of 190 nm and a solid content of 21.5%.

Toner Example 1

(Production of Toner Particle)

| | |
|---|---|
| Amorphous Resin Particle Liquid Dispersion (A1) | 210 parts by weight (resin: 42 parts by weight) |
| Colorant Particle Liquid Dispersion (P1) | 40 parts by weight (pigment: 8.6 parts by weight) |
| Releasing Agent Particle Liquid Dispersion (W1) | 40 parts by weight (releasing agent: 8.6 parts by weight) |
| Polyaluminum chloride | 0.15 parts by weight |
| Ion exchanged water | 300 parts by weight |

These components are thoroughly mixed and dispersed by a homogenizer (Ultra-Turrax T50, manufactured by IKA Works, Inc.) in a round stainless steel-made flask, and the resulting dispersion is heated to 42° C. by a heating oil bath while stirring the flask, held at 42° C. for 60 minutes and after adding 50 parts by weight (resin: 21 parts by weight) of Amorphous Resin Particle Liquid Dispersion (A1), gently stirred.

Thereafter, the pH in the system is adjusted to 6.0 with 0.5 mol/liter of an aqueous sodium hydroxide solution, and while continuing the stirring, the dispersion is heated to 80° C.

During the elevation of temperature to 80° C., the pH in the system usually lowers to 5.0 or less, but here, the pH is kept from lowering to 5.5 or less by additionally adding dropwise the aqueous sodium hydroxide solution. After the completion of reaction, the reaction solution is cooled to 55° C., held at this temperature for 3 hours and then again cooled to room temperature. Furthermore, the reaction solution is filtered, thoroughly washed with ion exchanged water and subjected to solid-liquid separation by Nutsche suction filtration. The resulting product is redispersed in 3 liter of ion exchanged water at 40° C. and then washed by stirring at 300 rpm for 15 minutes. After repeating this washing operation 5 times, the product is subjected to solid-liquid separation by Nutsche suction filtration and then vacuum-dried for 12 hours to obtain toner particles (Toner 1). The particle diameter of this toner particle is measured by a Coulter counter, as a result, the accumulated volume average particle diameter $D_{50}$ is 5.5 μm and the volume average particle size distribution index GSDv is 1.17. Also, the shape factor SF1 of the toner particle determined by shape observation using a Luzex image analyzer is 135, and this indicates a potato-like shape.

<Preparation of External Addition Toner>

A silica ($SiO_2$) particle subjected to a surface hydrophobing treatment with hexamethyldisilazane (hereinafter sometimes simply referred to as "HMDS") and having an average primary particle diameter of 40 nm, and a metatitanic acid compound fine particle having an average primary particle diameter of 20 nm, which is a reaction product of metatitanic acid and isobutyltrimethoxysilane, are added each in an amount of 1 wt %, and mixed in a Henschel mixer to produce a cyan external addition toner.

<Production of Carrier>

A methanol solution containing 0.1 part by weight of γ-aminopropyltriethoxysilane is added to 100 parts by weight of Cu—Zn ferrite fine particles having a volume average particle diameter of 40 μm and after coating the particles in a kneader, methanol is removed by distillation. The obtained silane compound is heated at 120° C. for 2 hours and thereby completely hardened. Subsequently, a perfluorooctylethyl methacrylate-methyl methacrylate copolymer (copolymerization ratio: 40:60) dissolved in toluene is added to the particles obtained, and the resulting mixture is treated in a vacuum kneader to produce a resin-coated carrier in which the coverage of the perfluorooctylethyl methacrylate-methyl methacrylate copolymer is 0.5 wt %.

<Production of Developer>

5 Parts by weight of each of the toners produced above is mixed with 100 parts by weight of the thus-obtained resin-coated carrier by a V-blender for 20 minutes to produce an electrostatic image developer. These developers are used as the developer in the following evaluations.

(Evaluation of Toner)

The fixing property of the toner is examined by using the developer prepared above in a modified machine of DocuCenter Color 500 manufactured by Fuji Xerox Co., Ltd., where J coat paper produced by Fuji Xerox Co., Ltd. is used as the transfer sheet and the process speed is adjusted to 180 mm/sec. As a result, the oilless fixing property by a PFA tube fixing roll is good, the fixing temperature (this temperature is judged by the image staining when the image is rubbed with cloth) is 120° C. or more, and the image exhibited satisfactory fixing property. Also, both developability and transferability are satisfied, and a good initial image quality with high quality and free from image defects (A) is obtained.

<Measurement of Charged Amount of Developer Under High Temperature·High Humidity Conditions>

The charged amount of the developer under high-temperature high-humidity conditions is measured by the following method. That is, the developer prepared is left standing in a high-temperature high-humidity environment of 30° C. and 80% for 20 hours, and the amount of the reverse-polarity toner is measured by an apparatus for measuring the electrostatic charge distribution of toner (E-Spart Analyzer, manufactured by Hosokawa Micron Corp.).

[Criteria for Evaluation of Chargeability Under High-Temperature High-Humidity Conditions]

A: The amount of reverse-polarity toner is less than 5%.

B: The amount of reverse-polarity toner is from 5% to less than 10%.

C: The amount of reverse-polarity toner is 10% or more.

The rating A is judged as "passed".

<Measurement of Minimum Fixing Temperature of Toner>

The minimum fixing temperature of the toner is evaluated by the following method.

The minimum fixing temperature of the toner is measured in a modified machine of DocuCenter Color 500 manufactured by Fuji Xerox Co., Ltd., where J coat paper produced by Fuji Xerox Co., Ltd. is used as the transfer sheet, the process speed is adjusted to 180 mm/sec, and the fixing roll temperature is set by 5° C. steps from 90° C. The evaluation of the minimum fixing temperature of the toner is as follows.

[Criteria for Evaluation of Fixing Property of Toner]

A: The minimum fixing temperature is less than 120° C.

B: The minimum fixing temperature is from 120° C. to less than 140° C.

C: The minimum fixing temperature is 140° C. or more.

The rating A is judged as "passed".

<Criteria for Evaluation of Initial Image Quality>

An image is formed under the above-described conditions, and the initial image quality is evaluated according to the following criteria.

A: Very good in all of image density, background staining and fine line reproducibility (no image defect).

B: Slightly poor in image density, background staining and fine line reproducibility but no problem in practice (some image defects).

C: Poor in any one of image density, background staining and fine line reproducibility (image defects are present).

The rating A is judged as "passed".

<Evaluation of Long-Term Maintenance of Image Quality Under High-Temperature-High-Humidity Conditions>

A continuous printing test of 50,000 sheets is performed in the modified machine above under high-temperature high-humidity conditions of 30° C. and 80%, but the initial good image quality is maintained to the last and filming on the photoreceptor or the like is not generated at all (evaluation of image quality under high-temperature high-humidity conditions: A).

[Criteria for Evaluation of Image Quality Under High-Temperature·High-Humidity Conditions]

A: Good maintenance of image quality, no filming on photoreceptor.

B: Good maintenance of image quality in the range of continuous printing of 50,000 sheets, but slight filming on photoreceptor is observed.

C: Deterioration of image quality and filming on photoreceptor are observed.

Toner Example 2

Toner 2 is produced in the same manner as the toner used in Example 1 by using Resin Particle Liquid Dispersion (A2) shown in Table 2, and a developer is produced in the same manner as in Example 1.

Toner Example 3

Toner 3 is produced in the same manner as the toner used in Example 1 by using Resin Particle Liquid Dispersions (A1) and (C1) shown in Table 2, and a developer is produced in the same manner as in Example 1. The mixing ratio of Resin Particle Liquid Dispersions (A1) and (C1) is as follows.

| | | |
|---|---|---|
| Amorphous Resin Particle Liquid Dispersion (A1) | 210 | parts by weight (resin: 42 parts by weight) |
| Crystalline Resin Particle Liquid Dispersion (C1) | 50 | parts by weight (resin: 21 parts by weight) |
| Colorant Particle Liquid Dispersion (P1) | 40 | parts by weight (pigment: 8.6 parts by weight) |
| Releasing Agent Particle Liquid Dispersion (W1) | 40 | parts by weight (releasing agent: 8.6 parts by weight) |
| Polyaluminum chloride | 0.15 | parts by weight |
| Ion exchanged water | 300 | parts by weight |

The production process is performed in the same manner as in Example 1, and the results obtained are shown in Table 2 below.

Toner Example 4

Toner 4 is produced in the same manner as the toner used in Example 3 by using Resin Particle Liquid Dispersions (A1) and (C2) shown in Table 2, and a developer is produced in the same manner as in Example 1. The mixing ratio of Resin Particle Liquid Dispersions (A1) and (C2) is the same as that in Example 3, and the production process is also the same.

Toner Comparative Example 1

Toner 5 is produced in the same manner as in Example 1 except for using Resin Particle Liquid Dispersion (A3) in place of (A1), and a developer is produced in the same manner as in Example 1.

Toner Comparative Example 2

Toner 6 is produced in the same manner as in Example 1 except for using Resin Particle Liquid Dispersion (A4) in place of (A1), and a developer is produced in the same manner as in Example 1.

Toner Comparative Example 3

Toner 7 is produced in the same manner as in Example 1 except for using Resin Particle Liquid Dispersion (C3) in place of (A1), and a developer is produced in the same manner as in Example 1.

Toner Comparative Example 4

Toner 8 is produced in the same manner as in Example 1 except for using Resin Particle Liquid Dispersion (A5) in place of (A1), and a developer is produced in the same manner as in Example 1.

The toners produced in Toner Examples 2 to 4 and Toner Comparative Examples 1 to 4 are also evaluated in the same manner as in Toner Example 1. The evaluation results are shown in Table 2 below.

TABLE 2

| Toner Example | Amorphous Resin Particle Liquid Dispersion | Crystalline Resin Particle Liquid Dispersion | Toner Diameter (μm) | GSDv | Evaluation of Chargeability Under High-Temperature High-Humidity Conditions | Evaluation of Minimum Fixing Temperature | Evaluation of Initial Image Quality | Evaluation of Image Quality Under High-Temperature High-Humidity Conditions |
|---|---|---|---|---|---|---|---|---|
| Example 1 | A1 | none | 5.5 | 1.17 | A | A | A | A |
| Example 2 | A2 | none | 5.4 | 1.18 | A | A | A | A |
| Example 3 | A1 | C1 | 5.3 | 1.19 | A | A | A | A |
| Example 4 | A1 | C2 | 5.6 | 1.14 | A | A | A | A |
| Comparative Example 1 | A3 | none | 15.6 | 2.8 | C | C | C | C |
| Comparative Example 2 | A4 | none | 12.6 | 2.5 | C | C | C | C |
| Comparative Example 3 | none | C3 | 5.8 | 1.4 | C | C | C | C |
| Comparative Example 4 | A5 | none | 5.5 | 1.2 | C | C | C | C |

Comparative Example 5

Production of Amorphous Resin Particle Liquid Dispersion (A6)

A liquid dispersion is obtained by performing the polycondensation in the same manner as in Example 1 except for changing the amount of β-CEA used.

| | |
|---|---|
| 1,4-Cyclohexanedicarboxylic acid | 175 parts by weight |
| Bisphenol A-ethylene oxide (1 mol) adduct | 210 parts by weight |
| Bisphenol A-propylene oxide (1 mol) adduct | 100 parts by weight |
| Dodecylbenzenesulfonic acid | 0.35 parts by weight |

These materials are mixed and charged into a 2,000 ml-volume reactor equipped with a stirrer, and polycondensation is performed at 120° C. for 7 hours in a nitrogen atmosphere. After the polymerization time of 7 hours, 200 parts by weight of 2-carboxyethyl acrylate (β-CEA, produced by Rhodia) is added, and the polycondensation is further performed for 3 hours, as a result, a uniform and transparent amorphous polyester resin is obtained. The weight average molecular weight by GPC is 4,500, the glass transition temperature (on-set) is 31° C., and the resin acid value is 65 mg·KOH/g.

This resin is sampled in a small amount for the analysis, dissolved in tetrahydrofuran (THF), reprecipitated in water and dried to obtain a polymer. When NMR is measured, a peak assignable to the β-CEA terminal is obtained in the vicinity of 4.5 ppm.

To 100 parts by weight of this resin, 0.5 parts by weight of sodium n-dodecylbenzenesulfonate is added as the surfactant, and 300 parts by weight of ion exchanged water is further added. The resulting solution is heated at 90° C. and simultaneously with the heating, thoroughly mixed and dispersed by a homogenizer (Ultra-Turrax T50, manufactured by IKA Works, Inc.) in a round glass-made flask. Thereafter, the pH in the system is adjusted to 7.5 with 0.5 mol/liter of an aqueous sodium hydroxide solution and while continuing the stirring by the homogenizer, the dispersion is heated to 95° C. Subsequently, 0.5 parts by weight of potassium persulfate is added as the initiator, and the reaction is further continued at 90° C. for 5 hours to obtain a resin particle liquid dispersion of copolymer resin. Amorphous Resin Particle Liquid Dispersion (A6) where the center diameter of the resin particle is 45 nm and the solid content is 20%, is obtained. This liquid dispersion is dried and analyzed, as a result, the weight average molecular weight by GPC is 4,500, the glass transition temperature (on-set) is 33° C., and the resin acid value is 66 mg·KOH/g.

A toner and a developer are produced and evaluated in the same manner as in Example 1, and the results obtained are shown in Table 3.

TABLE 3

| | Comparative Example 5 |
|---|---|
| Amorphous resin particle liquid dispersion | A5 |
| Component (a) (mol %) | 28.8 |
| Component (b) (mol %) | 31.8 |
| Component (c) (mol %) | 39.4 |
| Glass transition point (° C.) | 33 |
| Weight average molecular weight | 4,500 |
| Median diameter of resin particle (nm) | 45 |
| Acid value (mg · KOH/g) | 66 |
| Crystalline resin particle liquid dispersion | none |
| Toner diameter (μm) | 9.9 |
| GSDv | 2.54 |
| Evaluation of charged amount under high-temperature high-humidity conditions | C |
| Evaluation of minimum fixing temperature | C |
| Evaluation of initial image quality | C |
| Evaluation of image quality under high-temperature high-humidity conditions | C |

According to an exemplary embodiment of the present invention, a resin particle liquid dispersion for an electrostatic image developing toner, ensuring that when this is used for an electrostatic image developing toner, the low-temperature fixing property, the image quality, the chargeability under high-temperature high-humidity conditions and the long-term maintenance of image quality are excellent, can be provided.

Furthermore, according to an exemplary embodiment of the present invention, an electrostatic image developing toner excellent in the chargeability under high-temperature high-humidity conditions and the long-term maintenance of image quality and capable of satisfying both high image quality and low-temperature fixing can be provided by using the above-described resin particle liquid dispersion, and a production process of the toner, an electrostatic image developer, and an image forming method using the toner or developer can also be provided.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

This application claims priority under 35 USC 119 from Japanese patent document, 2005-366229, the disclosure of which is incorporated by reference herein.

What is claimed is:

1. A resin particle liquid dispersion for an electrostatic image developing toner, comprising:

a dispersion medium; and a resin particle containing at least a polyester dispersed in the dispersion medium, wherein the polyester comprises a terminal addition-polymerized polyester having an acid value of from about 5 to about 70 mg·KOH/g, and the terminal addition-polymerized polyester is obtained by a process comprising:

polycondensing a polycondensable monomer having a composition comprising:

(a) at least one of a polyvalent acid monomer having no addition-polymerizable unsaturated group and a derivative of the polyvalent acid monomer having no addition-polymerizable unsaturated group in an amount of from about 10 to about 80 mol % based on all monomers;

(b) a polyhydric alcohol monomer having no addition-polymerizable unsaturated group in an amount of from about 10 to about 80 mol % based on all monomers; and (c) at least one of a monomer having a carboxyl group and an addition-polymerizable unsaturated group and a derivative of the monomer having a carboxyl group and an addition-polymerizable unsaturated group in an amount of from about 0.5 to about 20 mol % based on all monomers, to obtain a polyester having an addition-polymerizable unsaturated group at a terminal; and addition-polymerizing the addition-polymerizable unsaturated group of the polyester having an addition-polymerizable unsaturated group at a terminal.

2. The resin particle liquid dispersion for an electrostatic image developing toner according to claim 1, wherein a molar ratio of the component (a) based on the component (b) is from about 0.5 to about 2.0.

3. The resin particle liquid dispersion for an electrostatic image developing toner according to claim 1, wherein a molar ratio of the component (a) based on the component (b) is from about 0.7 to about 1.5.

4. The resin particle liquid dispersion for an electrostatic image developing toner according to claim 1, wherein a molar ratio of the component (a) based on the component (b) is from about 0.8 to about 1.2.

5. The resin particle liquid dispersion for an electrostatic image developing toner according to claim 1, wherein a molar ratio of the number of hydroxy groups in the component (b) based on the number of carboxyl groups in the component (a) is from more than 1.0 to about 2.0.

6. The resin particle liquid dispersion for an electrostatic image developing toner according to claim 1, wherein a molar ratio of the number of hydroxy groups in the component (b) based on the number of carboxyl groups in the component (a) is from about 1.05 to about 1.8.

7. The resin particle liquid dispersion for an electrostatic image developing toner according to claim 1, wherein a molar ratio of the number of hydroxy groups in the component (b) based on the number of carboxyl groups in the component (a) is from about 1.05 to about 1.5.

8. The resin particle liquid dispersion for an electrostatic image developing toner according to claim 1, wherein the amount of the component (c) is from about 1.0 to about 10 mol % based on all monomers.

9. The resin particle liquid dispersion for an electrostatic image developing toner according to claim 1, wherein the terminal addition-polymerized polyester has an acid value of from about 8 to about 40 mg·KOH/g.

10. The resin particle liquid dispersion for an electrostatic image developing toner according to claim 1, wherein the terminal addition-polymerized polyester has an acid value of from about 10 to about 20 mg·KOH/g.

11. A process for producing a resin particle liquid dispersion for an electrostatic image developing toner, the process comprising:

polycondensing a polycondensable monomer having a composition comprising:

(a) at least one of a polyvalent acid monomer having no addition-polymerizable unsaturated group and a derivative of the polyvalent acid monomer having no addition-polymerizable unsaturated group in an amount of from about 10 to about 80 mol % based on all monomers;

(b) a polyhydric alcohol monomer having no addition-polymerizable unsaturated group in an amount of from about 10 to about 80 mol % based on all monomers; and (c) at least one of a monomer having a carboxyl group and an addition-polymerizable unsaturated group and a derivative of the monomer having a carboxyl group and an addition-polymerizable unsaturated group in an amount of from about 0.5 to about 20 mol % based on all monomers, with a polycondensation catalyst to obtain a polyester having an addition-polymerizable unsaturated group at a terminal, dispersing the polyester having an addition-polymerizable unsaturated group at a terminal in an aqueous medium; and addition-polymerizing the addition-polymerizable unsaturated group of the polyester having an addition-polymerizable unsaturated group at a terminal.

12. The process for producing a resin particle liquid dispersion for an electrostatic image developing toner according to claim 11, wherein reaction temperatures in the polycondensation and the addition polymerization are from about 70 to about 150° C.

13. The process for producing a resin particle liquid dispersion for an electrostatic image developing toner according to claim 11, wherein reaction temperatures in the polycondensation and the addition polymerization are from about 70 to about 140° C.

14. The process for producing a resin particle liquid dispersion for an electrostatic image developing toner according to claim 11, wherein reaction temperatures in the polycondensation and the addition polymerization are from about 80 to less than 140° C.

15. A process for producing an electrostatic image developing toner, the process comprising:

aggregating resin particles in a liquid dispersion comprising at least a resin particle liquid dispersion to obtain aggregate particles; and heating and coalescing the aggregate particles, wherein the resin particle liquid dispersion comprising:

a dispersion medium; and a resin particle containing at least a polyester dispersed in the dispersion medium, wherein the polyester comprises a terminal addition-polymerized polyester having an acid value of from about 5 to about 70 mg·KOH/g, and the terminal addition-polymerized polyester is obtained by a process comprising:

polycondensing a polycondensable monomer having a composition comprising:

(a) at least one of a polyvalent acid monomer having no addition-polymerizable unsaturated group and a derivative of the polyvalent acid monomer having no addition-polymerizable unsaturated group in an amount of from about 10 to about 80 mol % based on all monomers;

(b) a polyhydric alcohol monomer having no addition-polymerizable unsaturated group in an amount of from about 10 to about 80 mol % based on all monomers; and (c) at least one of a monomer having a carboxyl group and an addition-polymerizable unsaturated group and a derivative of the monomer having a carboxyl group and an addition-polymerizable unsaturated group in an amount of from about 0.5 to about 20 mol % based on all monomers, to obtain a polyester having an addition-polymerizable unsaturated group at a terminal; and addition-polymerizing the addition-polymerizable unsaturated group of the polyester having an addition-polymerizable unsaturated group at a terminal.

16. An electrostatic image developing toner produced by a process according to claim 15.

17. An electrostatic image developer comprising an electrostatic image developing toner according to claim 16 and a carrier.

18. An image forming method comprising:

forming an electrostatic latent image on a surface of a latent image holding member;

developing the electrostatic latent image formed on the surface of the latent image holding member with a developer containing a toner to form a toner image;

transferring the toner image formed on the surface of the latent image holding member to a surface of a transferee member; and heat-fixing the toner image transferred to the surface of the transferee member, wherein the toner is an electrostatic image developing toner according to claim 16.

19. An image forming method comprising:

forming an electrostatic latent image on a surface of a latent image holding member;

developing the electrostatic latent image formed on the surface of the latent image holding member with a developer containing a toner to form a toner image;

transferring the toner image formed on the surface of the latent image holding member to a surface of a transferee member; and heat-fixing the toner image transferred to the surface of the transferee member, wherein the developer is an electrostatic image developer according to claim 17.

* * * * *